US008948661B2

(12) United States Patent
Mushika et al.

(10) Patent No.: US 8,948,661 B2
(45) Date of Patent: Feb. 3, 2015

(54) CAP CONFIGURATION FOR A TONER CARTRIDGE

(71) Applicant: Brother Kogyo Kabushiki Kaisha, Nagoya (JP)

(72) Inventors: Motoaki Mushika, Hashima (JP); Tsutomu Suzuki, Nagoya (JP); Yasuo Fukamachi, Nagoya (JP); Fumikazu Sato, Konan (JP); Hikaru Yoshizumi, Handa (JP); Takahiro Nishimoto, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/275,251

(22) Filed: May 12, 2014

(65) Prior Publication Data

US 2014/0341617 A1 Nov. 20, 2014

Related U.S. Application Data

(63) Continuation of application No. 14/154,521, filed on Jan. 14, 2014, now Pat. No. 8,761,643, which is a continuation of application No. 13/222,096, filed on Aug. 31, 2011, now Pat. No. 8,666,293.

(30) Foreign Application Priority Data

Aug. 31, 2010 (JP) ..... 2010-193204

(51) Int. Cl.
*G03G 15/08* (2006.01)

(52) U.S. Cl.
CPC ..... *G03G 15/0877* (2013.01)
USPC ..... 399/262; 399/120

(58) Field of Classification Search
USPC ..... 399/262, 120, 111
See application file for complete search history.

(56) References Cited

U.S. PATENT DOCUMENTS 5,489,976 A 2/1996 Ichikawa
5,970,293 A 10/1999 Huang (Continued)

FOREIGN PATENT DOCUMENTS

JP 5323696 A 12/1993
JP 06-208301 A 7/1994

(Continued)

OTHER PUBLICATIONS

Decision to Grant a Patent issued in corresponding Japanese Patent Application No. 2010-193204 dated Sep. 18, 2012.

(Continued)

*Primary Examiner* — Sophia S Chen
(74) *Attorney, Agent, or Firm* — Banner & Witcoff, Ltd.

(57) ABSTRACT

Aspects described herein relate to a cap for a toner cartridge. In one example, the cap may be configured to close a toner supply opening of the toner cartridge. According to one or more aspects, the cap may include a sealing or covering portion configured to cover the toner supply opening and a shaft portion for rotatably supporting a to-be-detected rotary member. The to-be-detected rotary member 56 is rotatably supported around and fitted onto the shaft portion. Therefore, even if a toner supply opening of a cartridge is provided in a sidewall of the housing on a side where the to-be-detected rotary member is provided, e.g., a left sidewall, the toner supply opening and the to-be-detected rotary member can be provided in such a manner as to overlap each other.

20 Claims, 34 Drawing Sheets

(56) References Cited

U.S. PATENT DOCUMENTS

| | | | |
|---|---|---|---|
| 6,088,561 | A | 7/2000 | Kawamura et al. |
| 6,823,160 | B2 | 11/2004 | Okabe |
| 7,613,414 | B2 | 11/2009 | Kamimura |
| RE42,796 | E | 10/2011 | Ishii |
| 8,099,025 | B2 | 1/2012 | Ishikake |
| 2003/0185594 | A1 | 10/2003 | Okabe |
| 2006/0171737 | A1 | 8/2006 | Nishimura et al. |
| 2006/0245787 | A1 | 11/2006 | Ito et al. |
| 2008/0080904 | A1 | 4/2008 | Murayama et al. |
| 2009/0257782 | A1 | 10/2009 | Ishikake |

FOREIGN PATENT DOCUMENTS

| | | | |
|---|---|---|---|
| JP | H07-281519 | | 10/1995 |
| JP | 9222783 | A | 8/1997 |
| JP | 10-301382 | A | 11/1998 |
| JP | 2000338760 | A | 12/2000 |
| JP | 2003295614 | A | 10/2003 |
| JP | 2008-089731 | A | 4/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009-276727 | A | 11/2009 |
| JP | 2009-288549 | A | 12/2009 |

OTHER PUBLICATIONS

Notice of Reasons for Rejection issued in Japanese Patent Application No. 2012-229560 mailed Feb. 19, 2013.

Office Action received in related Chinese Patent Application No. 201110251898.6 mailed Oct. 15, 2013.

Notification of the First Office Action with Search Report issued in corresponding Chinese Patent Application No. 201110251898.6 dated Dec. 11, 2012.

Notice of Reasons for Rejection issued in corresponding Japanese Patent Application 2010-193204 mailed Jun. 26, 2012.

84

7

CAP CONFIGURATION FOR A TONER CARTRIDGE

CROSS-REFERENCE TO RELATED APPLICATIONS

This application is a continuation of co-pending U.S. application Ser. No. 14/154,521 filed Jan. 14, 2014, which is a continuation of co-pending U.S. application Ser. No. 13/222,096 filed Aug. 31, 2011, issued as U.S. Pat. No. 8,666,293, which claims priority to Japanese Patent Application No. 2010-193204 filed Aug. 31, 2010. The entire contents of all of the applications mentioned above are hereby incorporated by reference.

TECHNICAL FIELD

Aspects described herein relate to a cartridge configured to be attached to a body of an image-forming apparatus such as a laser printer, and to a cap included in the same.

BRIEF SUMMARY

According to one or more aspects, a cap configured for attachment to and closing a toner supply opening provided in a housing having a space therein for storing toner is provided. In some arrangements, the cap includes a covering or sealing portion that is configured to cover the toner supply opening, and a shaft portion onto and around which a rotary member is to be fitted, the shaft portion being provided for rotatably supporting the rotary member.

DETAILED DESCRIPTION

Example embodiments of the present invention will now be described in detail with reference to the accompanying drawings.

1. Laser Printer

Figure 1:
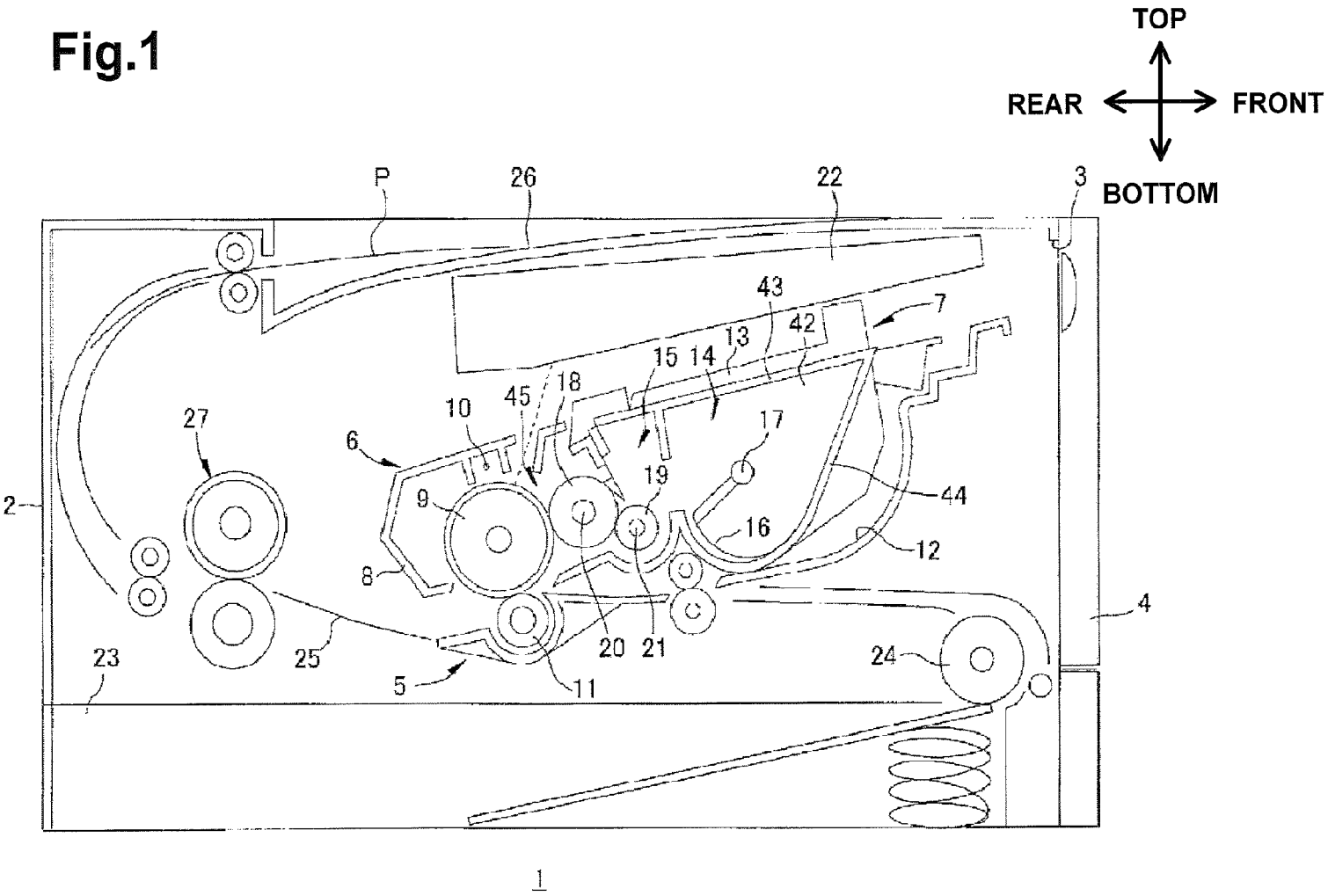
FIG. 1 is a sectional view of an illustrative laser printer in which a development cartridge according to an embodiment of the present invention is provided.

As illustrated in FIG. 1, an example image-forming apparatus such as a laser printer 1 includes a body casing 2 as an example apparatus body. The body casing 2 has in one sidewall thereof a cartridge-detaching opening 3 and a front cover 4 that opens and closes the cartridge-detaching opening 3.

Note that, in the following description, the side on which the front cover 4 is provided is defined as the front of the laser printer 1. The vertical and lateral directions of the laser printer 1 are defined from a perspective of the laser printer 1 seen from the front. Furthermore, the anteroposterior direction of a below-described development cartridge 7 is defined with reference to a state of the development cartridge 7 attached to the body casing 2, and the vertical and lateral directions of the development cartridge 7 are defined from a perspective of the development cartridge 7 seen from the front.

A process cartridge 5 is provided in the body casing 2 at a position slightly to the front of the center. The process cartridge 5 is attached to and detached from the body casing 2 through the cartridge-detaching opening 3 with the front cover 4 opened.

The process cartridge 5 includes a drum cartridge 6 and the development cartridge 7 as an example cartridge detachably attached to the drum cartridge 6.

The drum cartridge 6 includes a drum frame 8. A photosensitive drum 9 is rotatably held in a rear end part of the drum frame 8. Furthermore, a charging device 10 and a transfer roller 11 are held by the drum frame 8. The charging device 10 and the transfer roller 11 are provided above and below the photosensitive drum 9, respectively.

A part of the drum frame 8 to the front of the photosensitive drum 9 forms a development-cartridge-attaching portion 12. The development cartridge 7 is attached to the development-cartridge-attaching portion 12.

The development cartridge 7 includes a housing 13 in which toner is contained or stored. A toner-containing chamber 14 and a development chamber 15 that communicate with each other are provided in the housing 13 next to each other in the anteroposterior direction.

The toner-containing chamber 14 is an exemplary space for containing toner. An agitator 16 is provided in the toner-containing chamber 14 in such a manner as to be rotatable about an agitator rotational shaft 17 extending in the lateral direction. When the agitator 16 rotates, the toner contained in the toner-containing chamber 14 is agitated and is delivered from the toner-containing chamber 14 to the development chamber 15.

A development roller 18 and a supply roller 19 are provided in the development chamber 15 in such a manner as to be rotatable about a development-roller shaft 20 and a supply-roller shaft 21, respectively, that extend in the lateral direction. The development roller 18 is provided such that a part of the surface (e.g., a peripheral surface) thereof is exposed through a rear end part of the housing 13. The development cartridge 7 is attached to the drum cartridge 6 such that the surface of the development roller 18 comes into contact with the surface (e.g., the peripheral surface) of the photosensitive drum 9. The supply roller 19 is provided such that the surface (e.g., the peripheral surface) thereof is in contact with the surface of the development roller 18 from the lower front. The toner in the development chamber 15 is supplied to the surface of the development roller 18 by the supply roller 19 and is borne in the form of a thin layer on the surface of the development roller 18.

Furthermore, an exposure device 22 including a laser and so forth is provided in the body casing 2 and above the process cartridge 5.

In forming an image, the photosensitive drum 9 is rotated clockwise when seen from the left and at a constant speed. When the photosensitive drum 9 is rotated, the surface of the photosensitive drum 9 is evenly charged by a discharge from the charging device 10. Meanwhile, a laser beam is emitted from the exposure device 22 on the basis of image data received from a personal computer (not illustrated) connected to the printer 1. The laser beam travels between the charging device 10 and the development cartridge 7 and is applied to the surface of the photosensitive drum 9 that has been evenly and positively charged, whereby the surface of the photosensitive drum 9 is selectively subjected to exposure. Thus, electrical charges are selectively eliminated from the exposed part of the photosensitive drum 9, whereby an electrostatic latent image is formed on the surface of the photosensitive drum 9. When the photosensitive drum 9 is rotated and the electrostatic latent image faces the development roller 18, toner is supplied from the development roller 18 to the electrostatic latent image. Thus, a toner image is formed on the surface of the photosensitive drum 9.

A paper feed cassette 23 that contains paper P is provided at the bottom of the body casing 2. A pickup roller 24 for feeding out the paper from the paper feed cassette 23 is provided above the paper feed cassette 23.

Furthermore, a conveyance path 25 having an S shape (when viewed from the side) is defined in the body casing 2. The conveyance path 25 extends from the paper feed cassette 23 through a position between the photosensitive drum 9 and the transfer roller 11 and reaches a paper discharge tray 26 formed by the top surface of the body casing 2. The paper P fed from the paper feed cassette 23 is conveyed along the conveyance path 25 toward the position between the photosensitive drum 9 and the transfer roller 11.

When the photosensitive drum 9 is rotated and the toner image faces the paper P passing through the position between the photosensitive drum 9 and the transfer roller 11, the toner image on the surface of the photosensitive drum 9 is electrically attracted to the transfer roller 11 and is transferred to the paper P.

A fixing device 27 is provided on the conveyance path 25 on the downstream side in the direction of conveyance of the paper P with respect to the transfer roller 11. The paper P having the toner image transferred thereto is conveyed along the conveyance path 25 and passes through the fixing device 27. In the fixing device 27, the toner image is fixed onto the paper P with heat and pressure so as to become an image. The paper P having the image thus formed thereon is further conveyed along the conveyance path 25 and is discharged onto the paper discharge tray 26.

2. Development Cartridge (1) Housing

As illustrated in the example arrangement of FIG. 1, the housing 13 of the development cartridge 7 has a box-like shape whose rear is open.

Specifically, the housing 13 includes a left sidewall 41 (see FIG. 2) and a right sidewall 42. The left sidewall 41 and the right sidewall 42 face each other in the lateral direction and each have a plate-like shape extending in the anteroposterior direction. The housing 13 also includes a top wall 43 extending between respective upper end parts of the left sidewall 41 and the right sidewall 42 and a bottom wall 44 extending between respective lower end parts of the left sidewall 41 and the right sidewall 42. A front end part of the bottom wall 44 extends upward while curving and is connected to a front end part of the top wall 43. A rear end part of the bottom wall 44 is not connected to a rear end part of the top wall 43. Thus, the housing 13 has a rectangular opening 45 (see FIG. 1) defined by respective rear end edges of the left sidewall 41, the right sidewall 42, the top wall 43, and the bottom wall 44.

Figure 2:
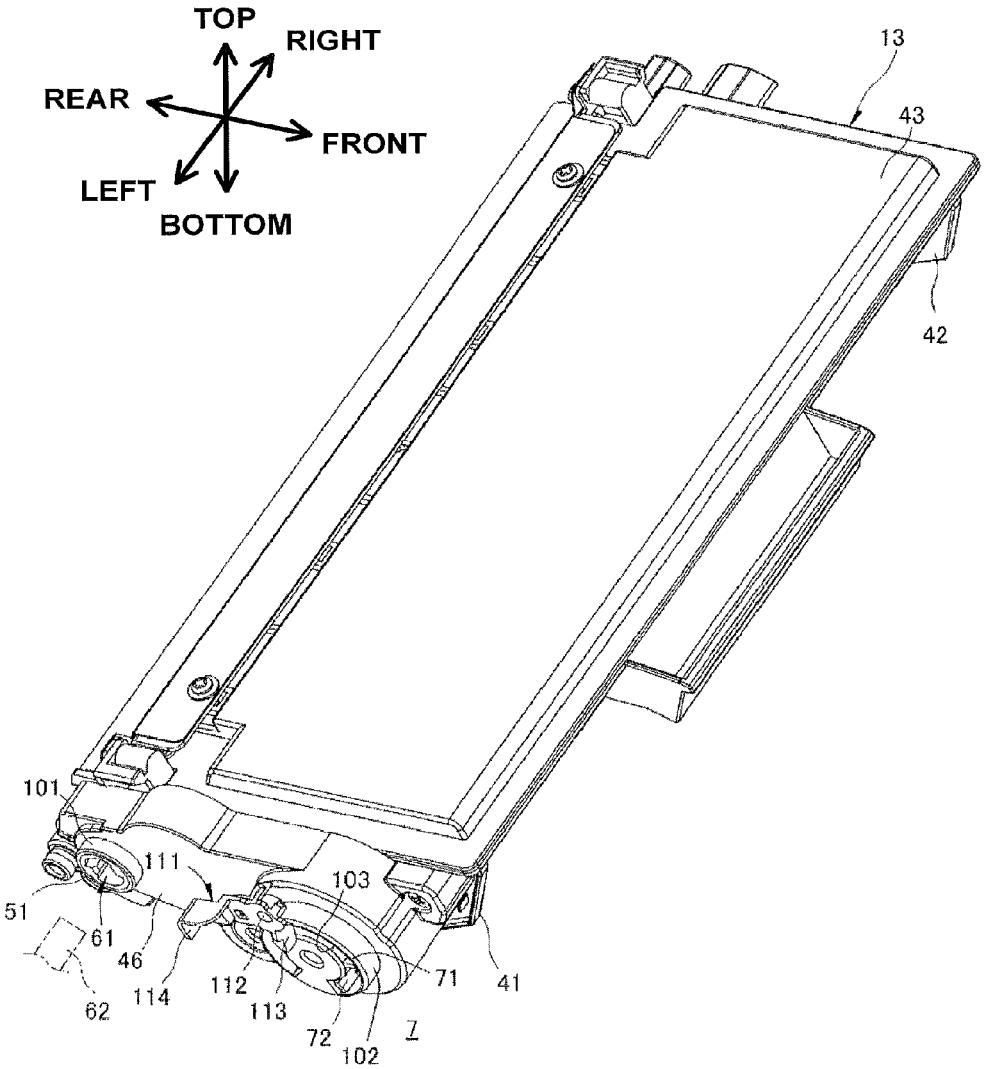
FIG. 2 is a perspective view of the example development cartridge illustrated in FIG. 1 seen from the upper front left.
Figure 3:
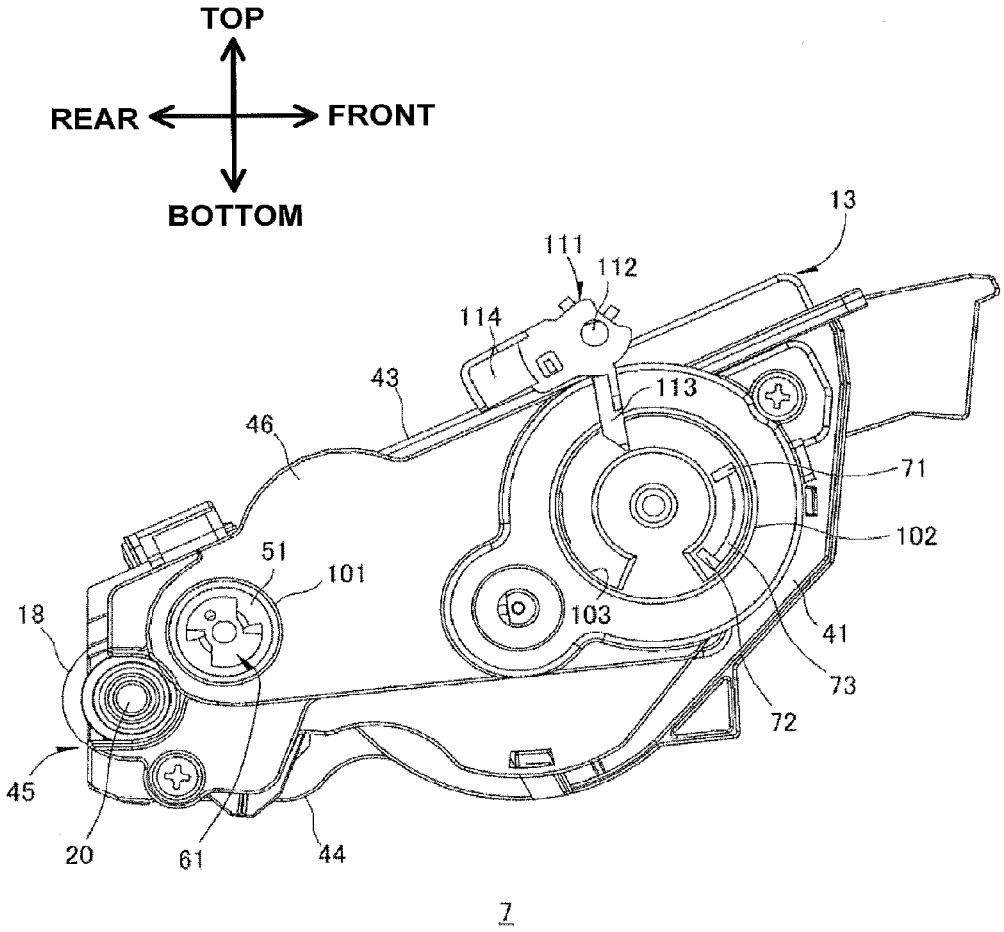
FIG. 3 is a left side view of the example development cartridge illustrated in FIG. 2.

As illustrated in the example arrangements of FIGS. 2 and 3, a gear cover 46 as an exemplary cover is attached to the outer surface (left side surface) of the left sidewall 41.

Furthermore, as illustrated in FIG. 3, a part of the surface of the development roller 18 is exposed to the outside from the opening 45.

(2) Gear Train

Figure 4:
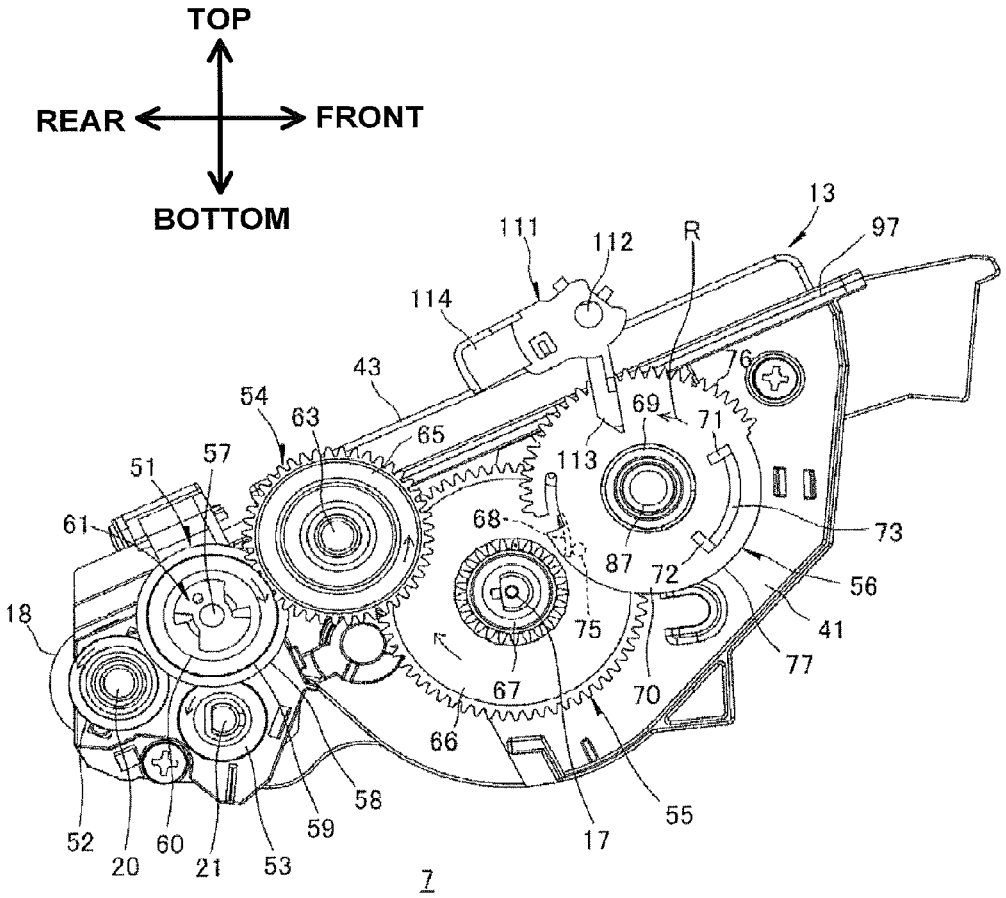
FIG. 4 is a left side view of the example development cartridge illustrated in FIG. 2 with a gear cover removed.
Figure 5:
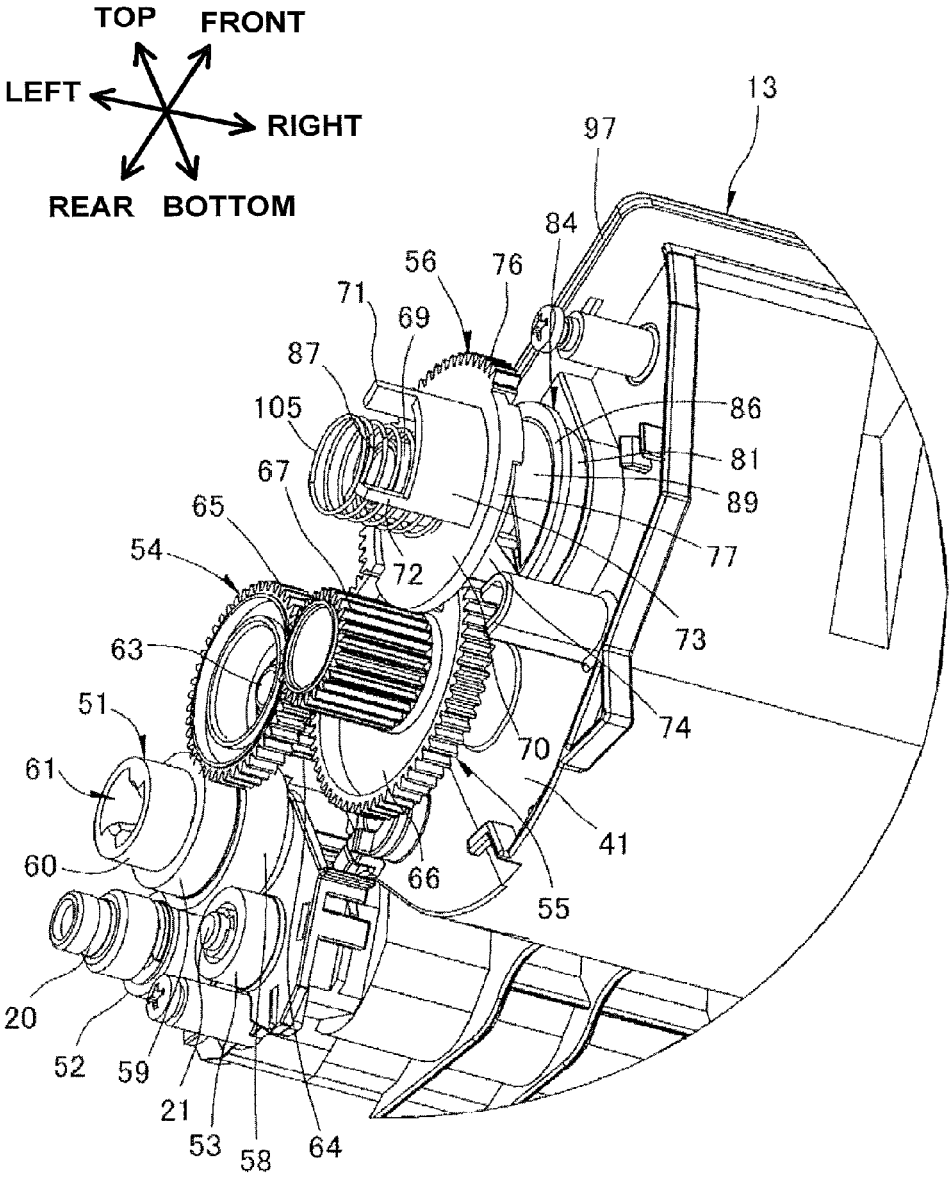
FIG. 5 is a perspective view of a left end part of the example development cartridge illustrated in FIG. 4 seen from the lower front left.

As illustrated in the example arrangements of FIGS. 4 and 5, a passive gear 51 configured as an example passive member, a development gear 52, a supply gear 53, an intermediate gear 54, an agitator gear 55, and a to-be-detected rotary member 56 configured as an example rotary member are provided on the inner side of the gear cover 46.

(2-1) Passive Gear

As illustrated in FIG. 4, the passive gear 51 is provided at the upper rear end of the left sidewall 41. The passive gear 51 is rotatably supported by an input-gear rotational shaft 57 extending in the lateral direction. The input-gear rotational shaft 57 is non-rotatably held by the left sidewall 41.

Furthermore, as illustrated in FIG. 5, the passive gear 51 includes a large-diameter gear portion 58, a small-diameter gear portion 59, and a coupling portion 60 that are provided as an integral body. The large-diameter gear portion 58, the small-diameter gear portion 59, and the coupling portion 60 are provided in that order from a side closer to the left sidewall 41.

The large-diameter gear portion 58 has a disc-like shape whose center axis coincides with that of the input-gear rotational shaft 57. The large-diameter gear portion 58 has non-illustrated gear teeth (for example, helical teeth) provided over the entirety of the peripheral surface thereof.

The small-diameter gear portion 59 has a disc-like shape whose center axis coincides with that of the input-gear rotational shaft 57, and has a smaller diameter than the large-diameter gear portion 58. The small-diameter gear portion 59 has non-illustrated gear teeth (for example, spur teeth) provided over the entirety of the peripheral surface thereof.

The coupling portion 60 has a round columnar shape whose center axis coincides with that of the input-gear rotational shaft 57, and has a peripheral surface defined by a smaller diameter than that defining the peripheral surface of the small-diameter gear portion 59. The coupling portion 60 has a coupling recess 61 in the left side surface thereof. In a state where the development cartridge 7 is in the body casing 2, a tip end part of a drive-outputting member 62 (see FIG. 2) provided in the body casing 2 is to be inserted into the coupling recess 61.

The drive-outputting member 62 is provided in such a manner as to be advanceable and retractable in the lateral direction. For example, the drive-outputting member 62 may be linked to a front cover 4 of the cartridge-detaching opening 3 of printer 1. As such, the drive-outputting member 62 may move in accordance with the opening and closing of the cover 4. In the state where the development cartridge 7 is in the body casing 2, the drive-outputting member 62 advances toward the right, and the tip end part thereof is inserted into the coupling recess 61. Thus, the drive-outputting member 62 and the coupling recess 61 are coupled to each other in such a manner as not to be rotatable relative to each other. Therefore, when the drive-outputting member 62 is rotated, the rotational force of the drive-outputting member 62 as a driving force is received by the passive gear 51, thus causing the passive gear 51 to rotate together with the drive-outputting member 62.

(2-2) Development Gear

As illustrated in FIG. 4, the development gear 52 is provided to the lower rear of the passive gear 51. The development gear 52 is attached to the development-roller shaft 20 of the development roller 18 in such a manner as not to be rotatable relative thereto. The development-roller shaft 20 rotatably extends through the left sidewall 41. The development gear 52 has non-illustrated gear teeth provided over the entirety of the peripheral surface thereof. The gear teeth are in mesh with the gear teeth of the large-diameter gear portion 58 of the passive gear 51.

(2-3) Supply Gear

As illustrated in FIG. 4, the supply gear 53 is provided below the passive gear 51. The supply gear 53 is attached to the supply-roller shaft 21 of the supply roller 19 (see FIG. 1) in such a manner as not to be rotatable relative thereto. For example, the supply-roller shaft 21 may have a particular shape matching a receiving portion of the supply gear 53 that does not allow the supply gear 53 to rotate with respect to the supply-roller shaft 21. The supply-roller shaft 21 rotatably extends through the left sidewall 41. The supply gear 53 has non-illustrated gear teeth provided over the entirety of the peripheral surface thereof. The gear teeth are in mesh with the gear teeth of the large-diameter gear portion 58 of the passive gear 51.

(2-4) Intermediate Gear

As illustrated in FIG. 4, the intermediate gear 54 is provided to the upper front of the passive gear 51. The intermediate gear 54 is rotatably supported by an intermediate-gear rotational shaft 63 extending in the lateral direction. The intermediate-gear rotational shaft 63 is non-rotatably held by the left sidewall 41.

Furthermore, as illustrated in FIG. 5, the intermediate gear 54 includes a disc-shaped small-diameter portion 64 having a relatively small outside diameter and a cylindrical-shaped large-diameter portion 65 having a relatively large outside diameter that are provided as an integral body. The small-diameter portion 64 and the large-diameter portion 65 are provided in that order from the side closer to the left sidewall 41. The center axes of the small-diameter portion 64 and the large-diameter portion 65 coincide with the center axis of the intermediate-gear rotational shaft 63.

The small-diameter portion 64 has gear teeth provided over the entirety of the peripheral surface thereof.

The large-diameter portion 65 has gear teeth provided over the entirety of the peripheral surface thereof. The gear teeth of the large-diameter portion 65 are in mesh with the gear teeth of the small-diameter gear portion 59 of the passive gear 51.

(2-5) Agitator Gear

As illustrated in FIG. 4, the agitator gear 55 is provided to the lower front of the intermediate gear 54. The agitator gear 55 is attached to the agitator rotational shaft 17 in such a manner as not to be rotatable relative thereto. For example, the agitator gear 55 may include a receiving portion keyed (e.g., matching a shape of) to a shape of shaft 17, thereby preventing rotation relative to shaft 17. The agitator rotational shaft 17 extends through the left sidewall 41 and the right sidewall 42 (see FIG. 1) in the lateral direction and is rotatably held by the left sidewall 41 and the right sidewall 42. In the housing 13, the agitator 16 (see FIG. 1) is attached to the agitator rotational shaft 17.

Furthermore, the agitator gear 55 includes a large-diameter gear portion 66 and a small-diameter gear portion 67 that are provided as an integral body.

The large-diameter gear portion 66 has a disc-like shape whose center axis coincides with that of the agitator rotational shaft 17. The large-diameter gear portion 66 has gear teeth provided over the entirety of the peripheral surface thereof. The gear teeth of the large-diameter gear portion 66 are in mesh with the gear teeth of the small-diameter portion 64 of the intermediate gear 54. Furthermore, the large-diameter gear portion 66 has a substantially arc-shaped plate-like pushing portion 68 standing or extending from the left end surface (outer surface) thereof in such a manner as to extend substantially in the radial direction of the large-diameter gear portion 66.

The small-diameter gear portion 67 is provided on a side opposite the left sidewall 41 with respect to the large-diameter gear portion 66. Additionally, the small-diameter gear portion 67 has a disc-like shape whose center axis coincides with that of the agitator rotational shaft 17, and has a smaller diameter than the large-diameter gear portion 66. The small-diameter gear portion 67 has gear teeth provided over the entirety of the peripheral surface thereof.

(2-6) To-be-Detected Rotary Member

As illustrated in FIG. 4, the to-be-detected rotary member 56 is provided to the upper front of the agitator gear 55. The to-be-detected rotary member 56 is rotatably supported by a shaft portion 87 extending in the lateral direction. The shaft portion 87 will be described separately below in detail.

Furthermore, as illustrated in FIG. 5, the to-be-detected rotary member 56 includes a fitting portion 69, a partially-toothless gear portion 70, a first to-be-detected portion 71, a second to-be-detected portion 72, a connecting portion 73, a supporting portion 74, and a to-be-pushed portion 75 (see FIG. 4) that are provided as an integral body.

The fitting portion 69 has a cylindrical shape whose inside diameter is substantially the same as the outside diameter of the shaft portion 87. For example, the inside diameter of fitting portion 69 may equal the outside diameter of shaft portion 87. By fitting the shaft portion 87 into the fitting portion 69, the to-be-detected rotary member 56 is rotatably supported by the shaft portion 87.

The partially-toothless gear portion 70 has a disc-like shape extending in the radial direction of the fitting portion 69 from a middle position of the fitting portion 69 in the direction of the center axis of the fitting portion 69 (the lateral direction). The partially-toothless gear portion 70 has gear teeth 76 provided on a part of the peripheral surface thereof. Specifically, the partially-toothless gear portion 70 includes a toothless part 77 on a part of the peripheral surface thereof defined by a center angle of about 205°, and the gear teeth 76 on the other part, except the toothless part 77, defined by a center angle of about 155°. The gear teeth 76 mesh with the gear teeth of the small-diameter gear portion 67 of the agitator gear 55 depending on the position of rotation of the to-be-detected rotary member 56. Furthermore, as described separately below, the thickness (the lateral-direction dimension) of the partially-toothless gear portion 70 is smaller than the lateral-direction dimension of the small-diameter gear portion 67 of the agitator gear 55 so that the two do not become out of mesh even if the partially-toothless gear portion 70 is moved in the lateral direction while the gear teeth 76 are in mesh with the gear teeth of the small-diameter gear portion 67 of the agitator gear 55.

The first to-be-detected portion 71, the second to-be-detected portion 72, and the connecting portion 73 stand or extend from the left end surface of the partially-toothless gear portion 70.

As illustrated in FIG. 4, the first to-be-detected portion 71 is provided on a line connecting an upstream end part of the series of gear teeth 76 in a direction of rotation R (the counterclockwise direction when seen from the left) of the to-be-detected rotary member 56 and the center axis of the fitting portion 69. The first to-be-detected portion 71 has a rectangular plate-like shape extending in the lateral direction and in the radial direction of the partially-toothless gear portion 70.

The second to-be-detected portion 72 is provided at a position on an arc whose center is defined on the center axis of the fitting portion 69 and passing the first to-be-detected portion 71. The position of the second to-be-detected portion 72 is defined on the upstream side in the direction of rotation R of the to-be-detected rotary member 56 with respect to the first to-be-detected portion 71 such that a line connecting the first to-be-detected portion 71 and the center axis of the fitting portion 69 and a line connecting the second to-be-detected portion 72 and the center axis of the fitting portion 69 form an angle of about 80°. The second to-be-detected portion 72 has a rectangular plate-like shape extending in the lateral direction and in the radial direction of the partially-toothless gear portion 70, and has the same lateral-direction dimension as the first to-be-detected portion 71.

The connecting portion 73 has a rib-like shape extending along the arc whose center is defined on the center axis of the fitting portion 69 and passing the first to-be-detected portion 71 and the second to-be-detected portion 72. The connecting portion 73 connects the first to-be-detected portion 71 and the second to-be-detected portion 72 to each other. As illustrated in FIG. 5, the lateral-direction dimension (height) of the connecting portion 73 is about half the lateral-direction dimension of the first to-be-detected portion 71 and the second to-be-detected portion 72.

As illustrated in FIG. 5, the supporting portion 74 stands or extends from the right end surface (inner surface) of the partially-toothless gear portion 70. The supporting portion 74 has a substantially triangular plate-like shape extending in the lateral direction and tapering toward the right.

The to-be-pushed portion 75 has a round columnar shape and stands or extends from the right end surface of the partially-toothless gear portion 70 at such a position that a line connecting a downstream end part of the series of gear teeth 76 in the direction of rotation R and the center axis of the fitting portion 69 and a line connecting the to-be-pushed portion 75 and the center axis of the fitting portion 69 form an angle of about 30°.

(3) Toner Supply Opening

Figure 6:
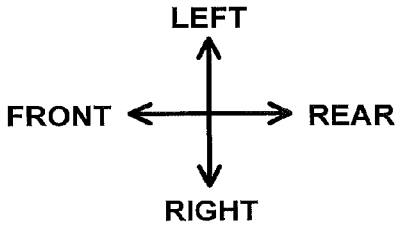
FIG. 6 is a sectional view of the example development cartridge illustrated in FIG. 2.
Figure 6:
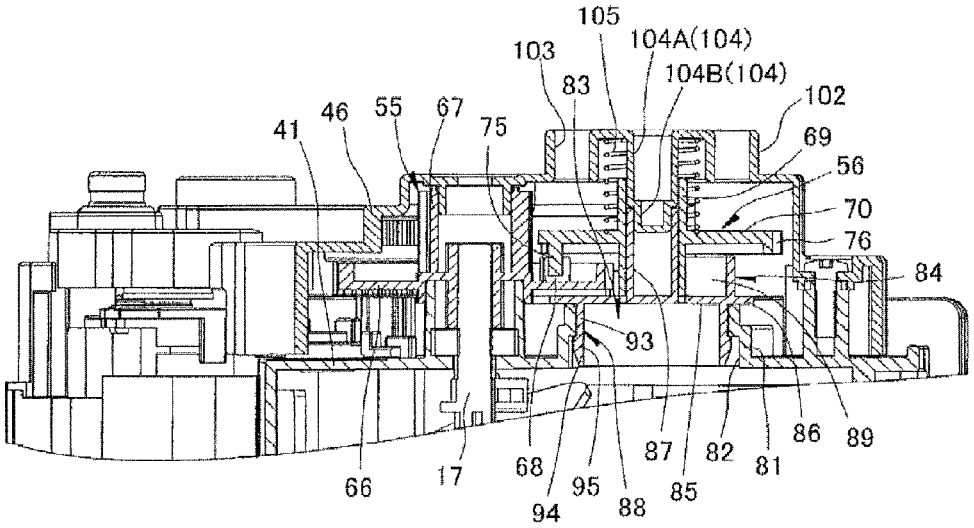

As illustrated in FIG. 6, the left sidewall 41 has a cylindrical-shaped cap-attaching portion 81 at a position on the outer surface thereof facing the to-be-detected rotary member 56. The left sidewall 41 has a through hole 82 in a part thereof surrounded by the cap-attaching portion 81. The inside diameter of the through hole 82 is the same as the inside diameter of the cap-attaching portion 81. Thus, the housing 13 has a toner supply opening 83 having a round shape in side view and defined by the inner peripheral surface of the cap-attaching portion 81 and the peripheral surface defining the through hole 82. The toner supply opening 83 is used in supplying toner into the housing 13 (e.g., the toner-containing chamber 14).

Furthermore, a left half part of the cap-attaching portion 81 has smaller outside and inside diameters than the other right half part. Thus, the inner peripheral surface defining the toner supply opening 83 has a step formed between the left half part (a part having relatively small outside and inside diameters compared to the right half part) and the other right half part (a part having relatively large outside and inside diameters compared to the left half part).

(4) Cap

A resin cap such as example resin cap 84 is provided over the toner supply opening 83. The toner supply opening 83 is tightly closed by the cap 84.

As illustrated in FIGS. 6 to 9, the cap 84 includes a sealing or covering portion 85, a contact portion 86, the shaft portion 87, a fit-in portion 88, a cam portion 89, a first rotation-stopping portion 90, a second rotation-stopping portion 91 as an example rotation-stopping portion, and a handle portion 92 that may be provided, in one or more arrangements, as an integral body. In one or more arrangements, rotation-stopping portions 90 and 91 may correspond to rotation-restricting portions configured to restrict rotation of one or more elements such as rotary member 56. In one or more examples, first rotation-restricting/stopping portion 90 is located proximate to the first sloped portion in a circumferential direction of the fit-in portion and the second rotation restriction/stopping portion 91 is located proximate to the second sloped portion in the circumferential direction of the fit-in portion.

According to one or more aspects, the sealing portion 85 may have a disc-like or plate-like shape with the same diameter as a left end part of the toner supply opening 83. The sealing portion 85 is a portion facing the toner supply opening 83 (a portion in front of the inner side of the toner supply opening 83). In one or more arrangements, sealing portion 85 may be a covering portion that is configured to cover a toner supply opening without necessarily sealing the opening. In other arrangements, sealing portion 85 may be configured to seal the toner supply opening (e.g., liquid-tight, air-tight, etc.).

Figure 7:
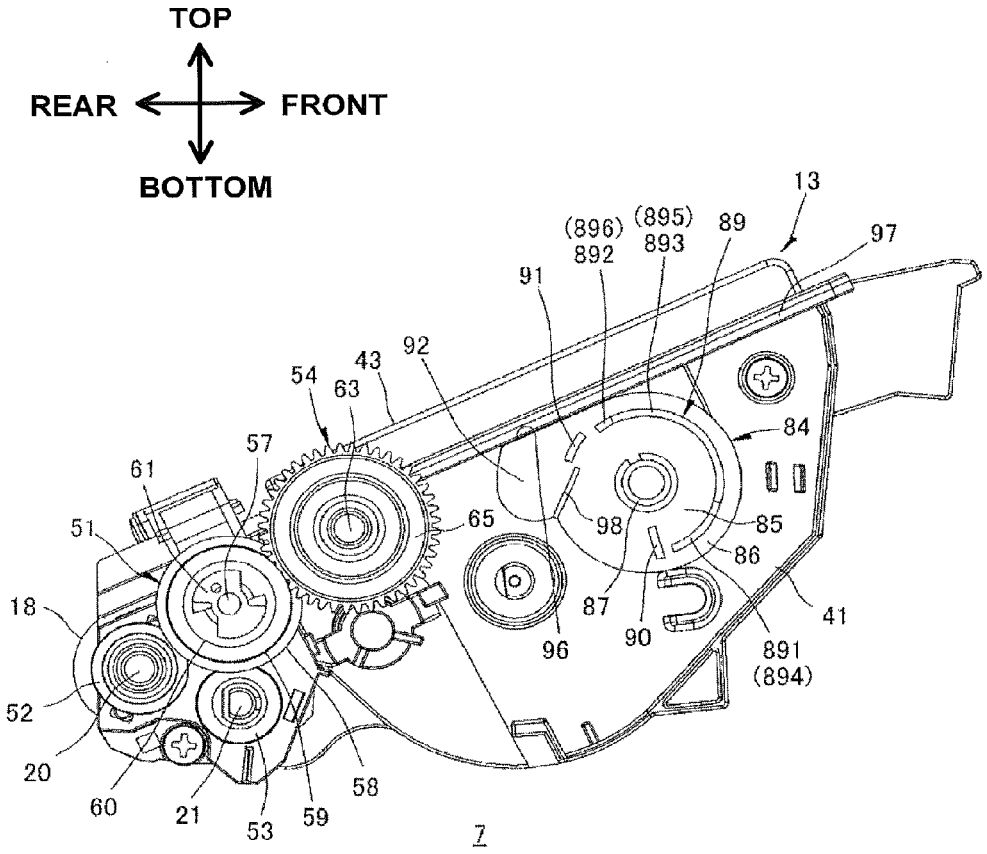
FIG. 7 is a left side view of the example development cartridge illustrated in FIG. 2 with the gear cover, an agitator gear, and a to-be-detected rotary member removed.
Figure 8:
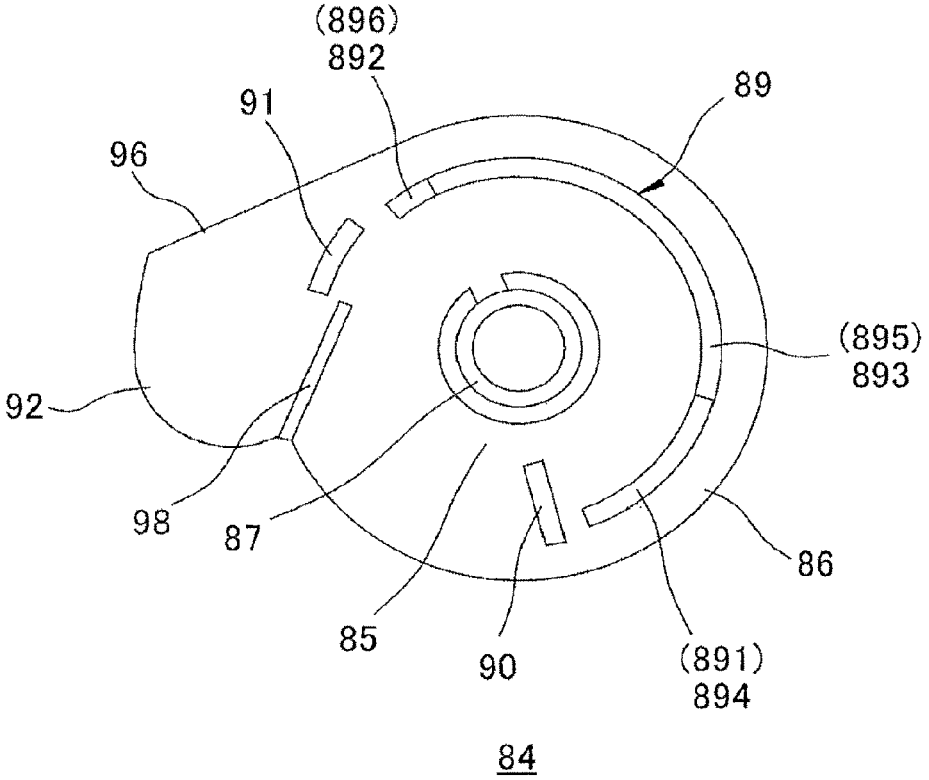
FIG. 8 is a left side view of an example cap illustrated in FIG. 7.

As illustrated in FIGS. 7 and 8, the contact portion 86 is provided around the sealing portion 85 and has a substantially C shape surrounding about 4/5 of the entire perimeter of the sealing portion 85. The contact portion 86 may surround other fractions or portions of the entire perimeter (e.g., 3/5, 7/8, 13/16, etc.). The contact portion 86, in this illustrative example, has the same thickness as the sealing portion 85. The contact portion 86 is configured to be in contact with the outer surface of the left sidewall 41. For example, the contact portion 86 and the sealing or covering portion 85 are separated by cam portion 89.

The shaft portion 87 has a cylindrical shape extending from the center of the sealing portion 85 toward the outer side. For example, shaft portion 87 may extend away from the toner supply opening 83, cartridge housing 13 and/or fit-in portion 88 when the fit-in portion 88 is inserted into the toner supply opening 83. In one particular example, shaft portion 87 may extend in a direction opposite to a direction in which fit-in portion 88 extends.

The fit-in portion 88 is a portion to be fitted into the toner supply opening 83. The fit-in portion 88 stands from the inner surface of the sealing portion 85 and has a cylindrical shape along the periphery of the sealing portion 85. As illustrated in FIG. 6, an end part of the fit-in portion 88 closer to the sealing portion 85, e.g., a base end part 93, has an outside diameter substantially the same as the diameter of the left end part of the toner supply opening 83 (the inside diameter of the left half part of the cap-attaching portion 81). A tip or free end part 94 of the fit-in portion 88 has a substantially triangular tapering shape in sectional view. Furthermore, a middle part 95 of the fit-in portion 88 between the base end part 93 and the tip/free end part 94 is thicker than the base end part 93 and projects away from a remainder of the fit-in portion 88 and/or toward an outside of a cartridge housing when the fit-in portion 88 is inserted into the toner supply opening. Thus, the outer peripheral surface of the fit-in portion 88 has a step between the base/tip end part 93 and the middle part 95. This step corresponds to the step of the inner peripheral surface defining the toner supply opening 83. In a state where the fit-in portion 88 is in the toner supply opening 83, the middle part 95 of the fit-in portion 88 is in contact with the left half part of the cap-attaching portion 81 from the right side, thereby functioning as an anchor catch or engaging portion that is configured to engage with and anchor to the cap-attaching portion 81.

As illustrated in FIGS. 7 and 8, the cam portion 89 stands from the outer surface of the contact portion 86 and has a thin wall-like shape (e.g., rib-like shape). In some arrangements, cam portion 89 extends in the same direction (e.g., away from a toner supply opening when the fit-in portion is in the toner supply opening) as shaft portion 87. Furthermore, the cam portion 89 has a semi-circular arcuate shape (from a side view such as a view along a longitudinal axis of the shaft portion 87) whose center is defined on the shaft portion 87. More specifically, in a state where the cap 84 is over the toner supply opening 83, the cam portion 89 has a substantially C shape curving in such a manner as to be convex toward the front. In such a state, one end of the cam portion 89 on the upstream side in the direction of rotation R (see FIG. 4) of the to-be-detected rotary member 56 is positioned to the lower front of the shaft portion 87 and the other end of the cam portion 89 on the opposite side (on the downstream side in the direction of rotation R) is positioned to the upper rear of the shaft portion 87.

Figure 9:
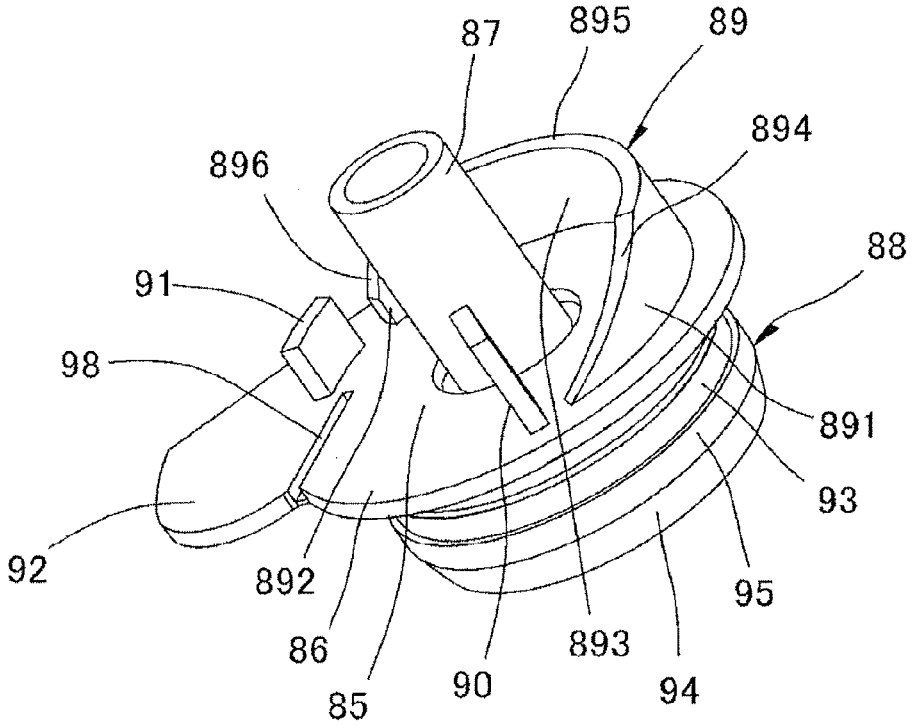
FIG. 9 is a perspective view of the example cap illustrated in FIG. 8.

Furthermore, as illustrated in FIG. 9, the amount of projection (the height) of the cam portion 89 from the outer surface of the contact portion 86 gradually increases (e.g., slopes upward) from one end part 891 positioned to the lower front of the shaft portion 87 toward the other end. The amount of projection of the cam portion 89 is constant in a part 893 (e.g., a level portion) provided between the one end part 891 and the other end part 892, and gradually decreases (e.g., slopes downward) from the other end part 892 toward the other end. Thus, the tip end surface (left end surface) of the cam portion 89 includes a sloping surface 894 in the part 891 where the amount of projection gradually increases, the sloping surface 894 sloping upwardly away from the contact portion 86 toward the downstream side in the direction of rotation R of the to-be-detected rotary member 56. The tip end surface of the cam portion 89 also includes a parallel surface 895 in the part 893 where the amount of projection is constant, the parallel surface 895 being parallel to the contact portion 86. The tip end surface of cam portion 89 further includes a sloping surface 896 in the part 892 where the amount of projection gradually decreases, the sloping surface 896 sloping downwardly toward the contact portion 86 and toward the downstream side in the direction of rotation R.

The first rotation-stopping portion 90 stands or extends from the outer surface of the contact portion 86 at a position on the upstream side in the direction of rotation R with respect to the cam portion 89 with a gap interposed therebetween. The first rotation-stopping portion 90 has a plate-like shape extending in the radial direction of the sealing portion 85 and in the lateral direction of the cartridge or printer 1.

The second rotation-stopping portion 91 stands/extends from the outer surface of the below-described handle portion 92 at a position on the downstream side in the direction of rotation R with respect to the cam portion 89 with a gap interposed therebetween. The second rotation-stopping portion 91 has a plate-like shape extending in the direction of rotation R and in the lateral direction of the cartridge or printer 1.

The handle portion 92 is disposed adjacent the sealing portion 85 and has a substantially arcuate shape with the same thickness as the sealing portion 85. In one or more examples, handle portion 92 extends perpendicularly to the longitudinal axis of the shaft portion 87 (e.g., when the handle portion 92 is in a non-broken state). Furthermore, a part of the handle portion 92 along one of the radii defining the substantially arcuate shape is connected to a part of the sealing portion 85 where the contact portion 86 is not provided.

As illustrated in FIGS. 8 and 9, a portion 96 of the handle portion 92 along the other of the radii defining the substantially arcuate shape slopes toward the upper front and is continuous with the periphery of the contact portion 86. The portion 96 is a positioning portion that determines the position of and/or aligns the cap 84 relative to the housing 13 in the direction of rotation R. That is, the left sidewall 41 has in the upper end part thereof a rib-like flange portion 97 as an example contact-receiving portion projecting toward the left and extending along the upper edge of the left sidewall 41. Furthermore, as illustrated in FIG. 7, the positioning portion 96 is in contact with the flange portion 97 from below in the state where the cap 84 is over the toner supply opening 83. Thus, the position of the cap 84 is determined relative to the left sidewall 41 in the direction of rotation R.

Furthermore, the cap 84 has a thin portion 98 provided along the boundary between the sealing portion 85 and the handle portion 92. The thin portion 98 is formed as a groove indented by one level from the surfaces of the sealing portion 85 and the handle portion 92, thereby being thinner than the sealing portion 85 and the handle portion 92.

(5) Gear Cover

As illustrated in FIG. 2, the gear cover 46 has in a rear end part thereof a cylindrical-shaped coupling-containing portion 101 that contains the coupling portion 60 of the passive gear 51. The gear cover 46 also has a rotary-member-containing portion 102 that contains the to-be-detected rotary member 56 therein. The rotary-member-containing portion 102 has a round shape in side view. Furthermore, the rotary-member-containing portion 102 has an opening 103 in the left end surface thereof at a position facing the first to-be-detected portion 71 and the second to-be-detected portion 72 of the to-be-detected rotary member 56. The opening 103 has a C shape with a lower part being open when viewed from the side.

The rotary-member-containing portion 102 has a boss 104 on the inner surface thereof. The boss 104 is provided such that, in a state where the gear cover 46 is on the left sidewall 41, the center axis of the boss 104 coincides with the center axis of the shaft portion 87 of the cap 84. A base end part 104A of the boss 104 has a cylindrical shape with an outside diameter slightly smaller than the inside diameter of the fitting portion 69 of the to-be-detected rotary member 56 and larger than the inside diameter of the shaft portion 87. A tip end part 104B of the boss 104 has a cylindrical shape with an outside diameter slightly smaller than the inside diameter of the shaft portion 87.

When the gear cover 46 is attached to the left sidewall 41, the tip end part 104B of the boss 104 is inserted into the shaft portion 87, whereby the tip end of the shaft portion 87 is held by the gear cover 46, and the to-be-detected rotary member 56 is rotatably held between the left sidewall 41 and the gear cover 46.

Furthermore, a coil spring 105 is provided between the partially-toothless gear portion 70 of the to-be-detected rotary member 56 and the inner surface of the gear cover 46 in such a manner as to be fitted on the fitting portion 69 and the boss 104. The to-be-detected rotary member 56 is pressed toward the left sidewall 41 by the urging force (elastic force) of the coil spring 105.

3. Detection Mechanism

As illustrated in FIGS. 2 to 4, a detection mechanism for detecting the first to-be-detected portion 71 and the second to-be-detected portion 72 is provided in the body casing 2. The detection mechanism includes an actuator 111 as an exemplary detecting member and a non-illustrated optical sensor.

The actuator 111 includes a rocker shaft 112 extending in the lateral direction, a contact lever 113 extending from the rocker shaft 112 toward the bottom, and a light-shielding lever 114 extending from the rocker shaft 112 toward the rear that may be provided as an integral body or as two or more separate components. The rocker shaft 112 is rotatably held by, for example, a non-illustrated inner wall portion of the body casing 2. The contact lever 113 and the light-shielding lever 114 meet each other at the rocker shaft 112 at an angle of about 80°.

Furthermore, the actuator 111 is provided in such a manner as to be rockable between a non-detected orientation (see FIG. 3) in which the contact lever 113 extends substantially vertically from the rocker shaft 112 toward the bottom and the light-shielding lever 114 extends slightly obliquely toward the lower rear and a detected orientation (see FIG. 11B) in which the contact lever 113 extends slightly obliquely toward the lower rear and the light-shielding lever 114 extends toward the rear. The actuator 111 is urged by the spring force of a non-illustrated spring in such a manner as to be in the non-detected orientation in a state where no external forces except the spring force are applied thereto.

The optical sensor includes a light-emitting element and a light-receiving element that are provided face to face in the lateral direction. Furthermore, the optical sensor is provided at such a position that the light-shielding lever 114 shields an optical path extending from the light-emitting element to the light-receiving element when the actuator 111 is in the non-detected orientation and that the light-shielding lever 114 is retracted from the optical path when the actuator 111 is in the detected orientation. When the light-shielding lever 114 is retracted (moved away) from the optical path extending between the light-emitting element and the light-receiving element, an on-signal is output from the optical sensor, for example.

4. Detection of Attaching of Development Cartridge and Detection of New Development Cartridge As illustrated in FIGS. 2 to 4, when the development cartridge 7 is new, the first to-be-detected portion 71 and the second to-be-detected portion 72 of the to-be-detected rotary member 56 are positioned to the front and to the lower front, respectively, of the shaft portion 87. In this state, some of the series of gear teeth 76 of the to-be-detected rotary member 56 on the most downstream side in the direction of rotation R are positioned above the small-diameter gear portion 67 of the agitator gear 55 and are therefore not in mesh with the gear teeth of the small-diameter gear portion 67. Furthermore, as illustrated in FIG. 5, the supporting portion 74 of the to-be-detected rotary member 56 is positioned between the cam portion 89 and the first rotation-stopping portion 90, with the tip end thereof being in contact with the contact portion 86 of the cap 84. Furthermore, the pushing portion 68 of the agitator gear 55 is in contact with the to-be-pushed portion 75 of the to-be-detected rotary member 56 from the upstream side in the direction of rotation of the agitator gear 55.

In a state immediately after a new development cartridge 7 is attached to the body casing 2, neither of the first to-be-detected portion 71 nor the second to-be-detected portion 72 are in contact with the contact lever 113 of the actuator 111 as illustrated in FIG. 3. Therefore, the actuator 111 is in the non-detected orientation, and the contact lever 113 faces the opening 103 of the gear cover 46 in the lateral direction. Furthermore, the optical path of the optical sensor is shielded by the light-shielding lever 114, and an off-signal is output from the optical sensor.

When the development cartridge 7 is attached to the body casing 2, a warm-up operation of the laser printer 1 is started. In the warm-up operation, the drive-outputting member 62 (see FIG. 2) is inserted into the coupling recess 61 of the passive gear 51, a driving force is input from the drive-outputting member 62 to the passive gear 51, and the passive gear 51 rotates clockwise when viewed from the left. Subsequently, the rotation of the passive gear 51 causes the development gear 52, the supply gear 53, and the intermediate gear 54 to rotate in the directions of their respective arrows illustrated in FIG. 4, thus causing the development roller 18 and the supply roller 19 rotate. Furthermore, the rotation of the intermediate gear 54 causes the agitator gear 55 to rotate clockwise when seen from the left, thereby causing the agitator 16 (see FIG. 1) to rotate. When the agitator 16 rotates, the toner in the housing 13 is agitated.

When the agitator gear 55 rotates, the pushing portion 68 pushes the to-be-pushed portion 75. The pushing causes the to-be-detected rotary member 56 to rotate in the direction of rotation R. When the to-be-detected rotary member 56 further rotates, the gear teeth 76 (see FIG. 4) of the to-be-detected rotary member 56 mesh with the gear teeth of the small-diameter gear portion 67 of the agitator gear 55. Subsequently, the driving force is transmitted from the gear teeth of the small-diameter gear portion 67 to the gear teeth 76 of the to-be-detected rotary member 56. The driving force causes the to-be-detected rotary member 56 to rotate in the direction of rotation R.

Figure 10A:
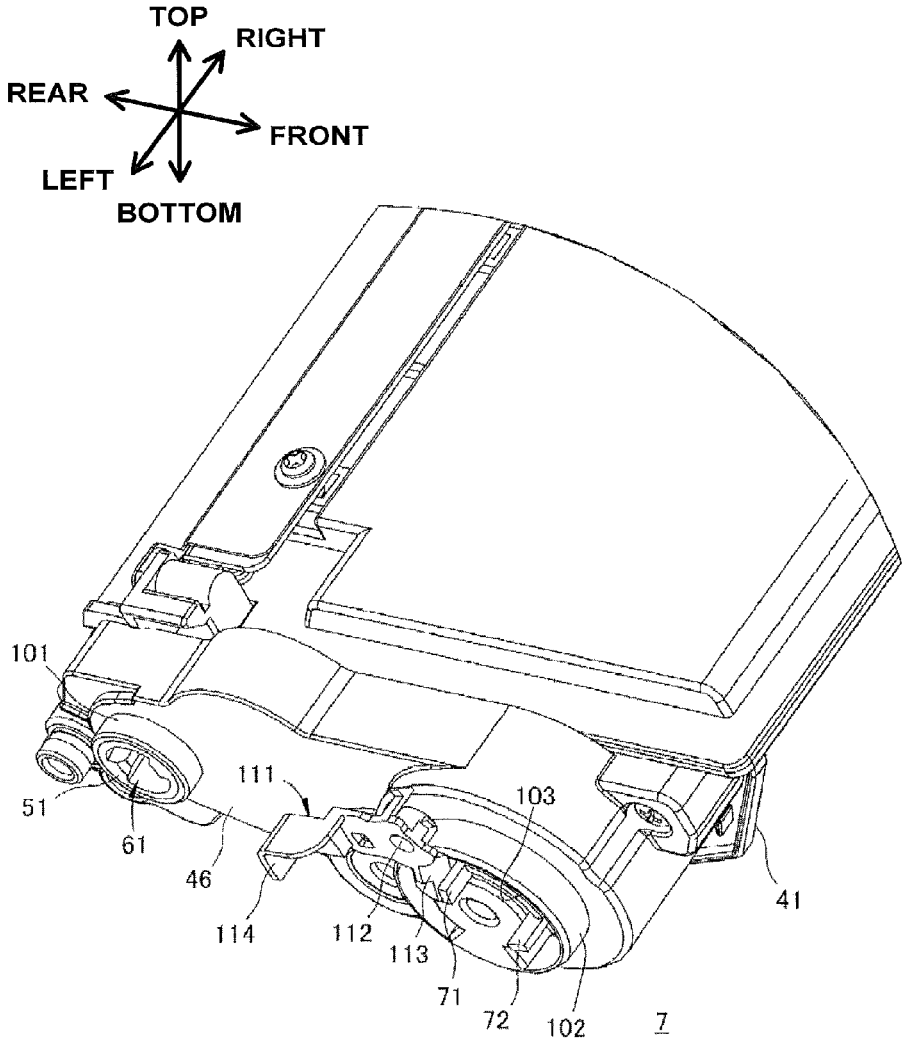
FIG. 10A is a perspective view of the left end part of the example development cartridge illustrated in FIG. 2 seen from the upper front left and in a state where a first to-be-detected portion faces a contact lever of an actuator.

When the to-be-detected rotary member 56 rotates, the supporting portion 74 of the to-be-detected rotary member 56 slides on the contact portion 86 (see FIG. 7) of the cap 84 toward the cam portion 89 and further slides on the sloping surface 894 of the cam portion 89 toward the parallel surface 895. Thus, with such a rotation, the to-be-detected rotary member 56 gradually moves toward the left. Meanwhile, when the to-be-detected rotary member 56 rotates, the first to-be-detected portion 71 and the second to-be-detected portion 72 move in the direction of rotation R. Therefore, the first to-be-detected portion 71 and the second to-be-detected portion 72 moving in the direction of rotation R gradually advance toward the left, and, as illustrated in FIG. 10A, the tip end parts thereof project toward the outer side from the opening 103 of the gear cover 46.

Figure 10B:
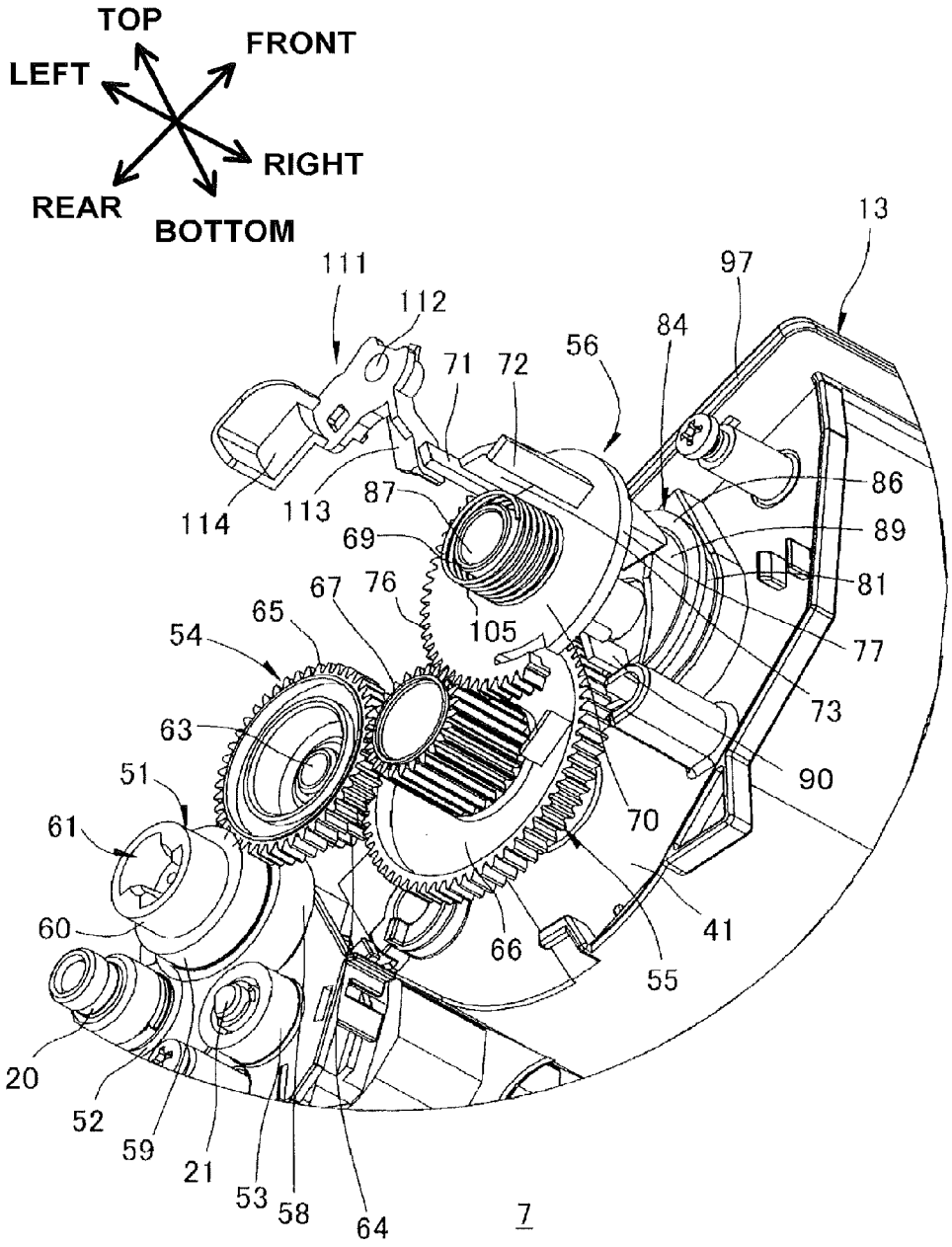
FIG. 10B is a perspective view of the left end part of the example development cartridge in the state illustrated in FIG. 10A seen from the lower front left with the gear cover removed.
Figure 10C:
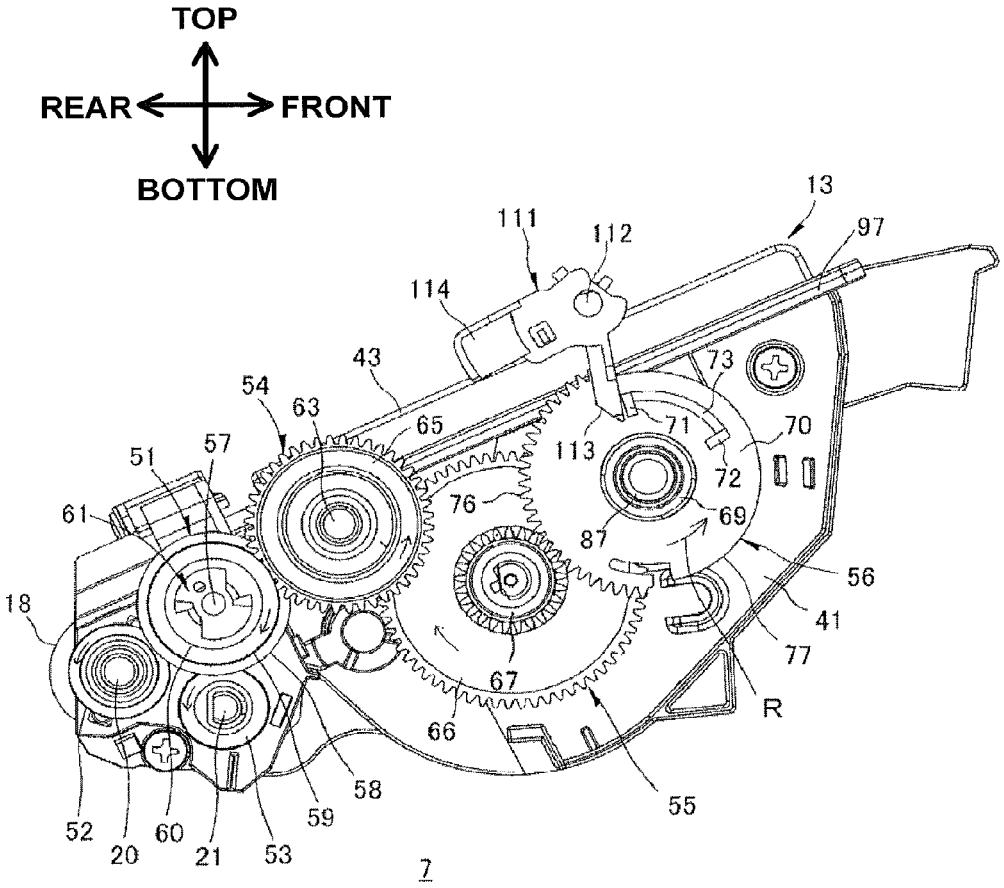
FIG. 10C is a left side view of the example development cartridge in the state illustrated in FIG. 10B with the gear cover removed.

When the to-be-detected rotary member 56 further rotates, the first to-be-detected portion 71 and the second to-be-detected portion 72 come nearer to the contact lever 113 of the actuator 111. Subsequently, as illustrated in FIG. 10B, the supporting portion 74 reaches a position near the boundary between the sloping surface 894 and the parallel surface 895 of the cam portion 89. Then, as illustrated in FIG. 10C, the tip end of the first to-be-detected portion 71 comes into contact with the contact lever 113.

Figure 11A:
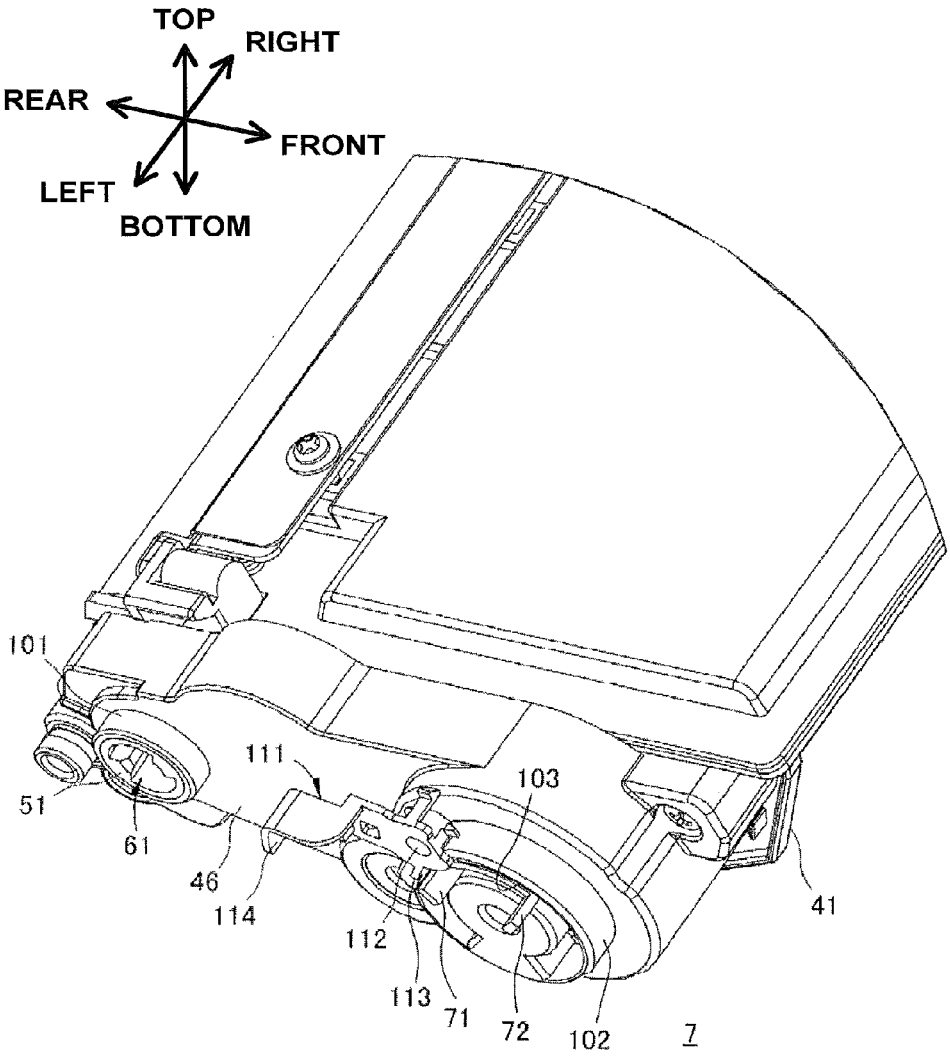
FIG. 11A is a perspective view of the left end part of the example development cartridge illustrated in FIG. 2 seen from the upper front left and in a state where the first to-be-detected portion is pushing the contact lever of the actuator.
Figure 11B:
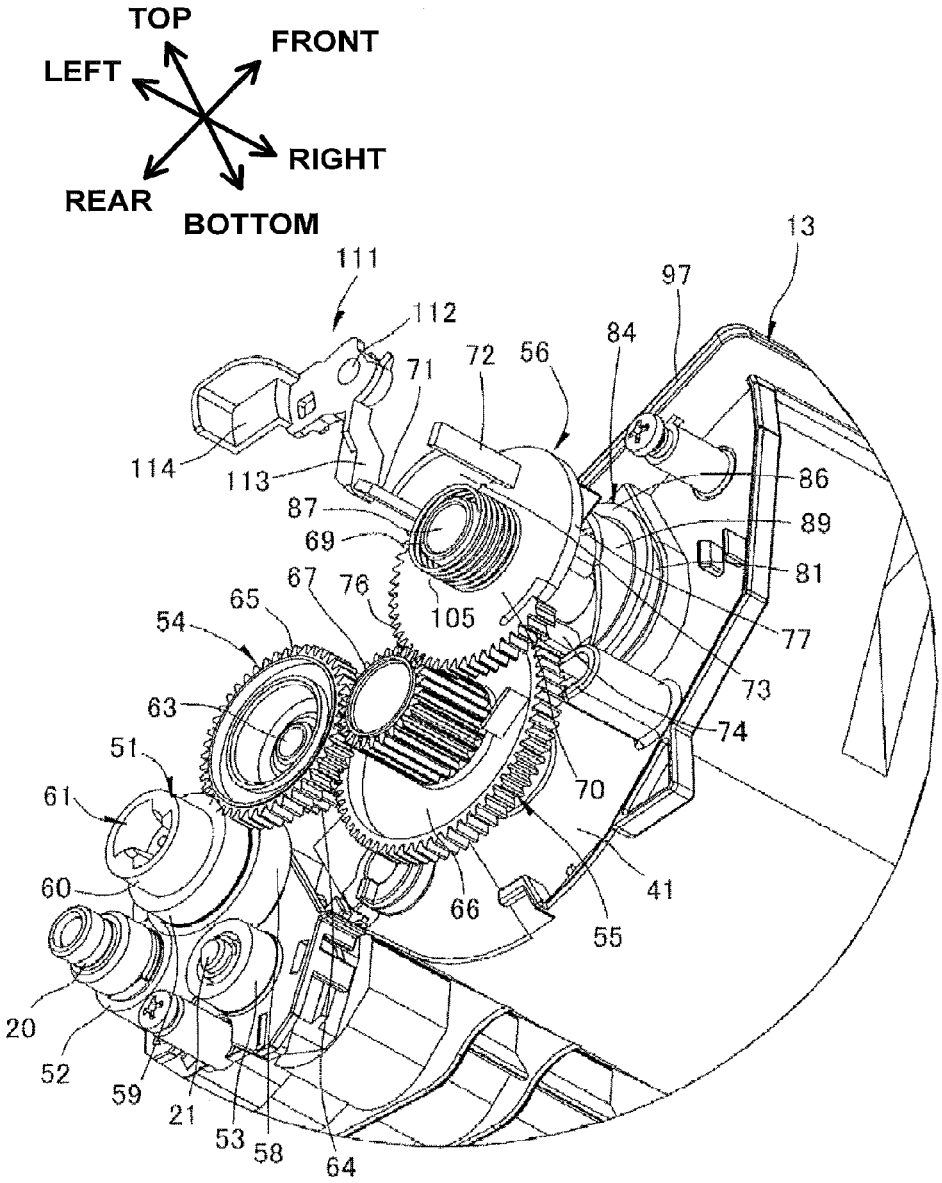
FIG. 11B is a perspective view of the left end part of the example development cartridge in the state illustrated in FIG. 11A seen from the lower front left with the gear cover removed.
Figure 11C:
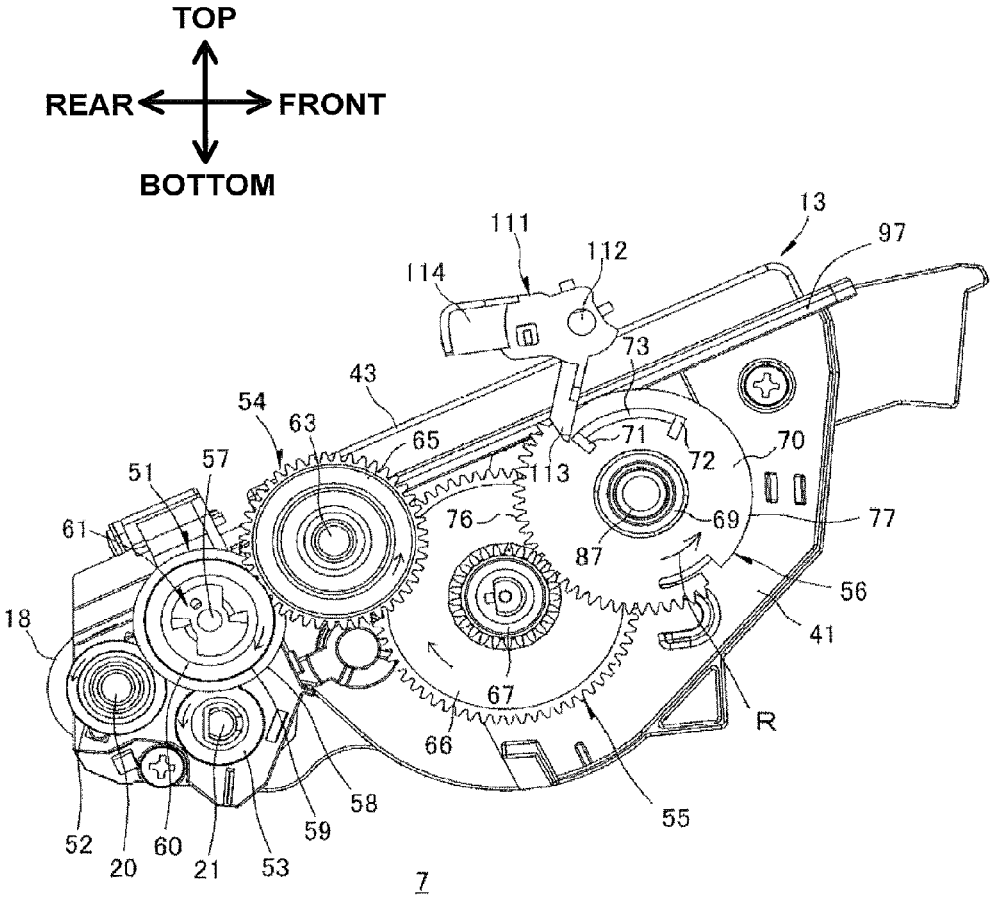
FIG. 11C is a left side view of the example development cartridge in the state illustrated in FIG. 11A with the gear cover removed.

When the to-be-detected rotary member 56 further rotates, the first to-be-detected portion 71 pushes the contact lever 113 toward the rear as illustrated in FIGS. 11A, 11B, and 11C, whereby the actuator 111 changes the orientation thereof from the non-detected orientation to the detected orientation. Consequently, the light-shielding lever 114 moves away from the optical path extending from the light-emitting element to the light-receiving element of the optical sensor, whereby the on-signal is output from the optical sensor. Thus, the detection of the first to-be-detected portion 71 is achieved.

Subsequently, when the to-be-detected rotary member 56 further rotates, the first to-be-detected portion 71 moves away from the contact lever 113, and the actuator 111 returns from the detected orientation to the non-detected orientation. Consequently, the optical path extending from the light-emitting element to the light-receiving element of the optical sensor is shielded by the light-shielding lever 114 again, whereby the output signal from the optical sensor changes from the on-signal to the off-signal. The supporting portion 74 of the to-be-detected rotary member 56 slides on the parallel surface 895 of the cam portion 89.

Figure 12A:
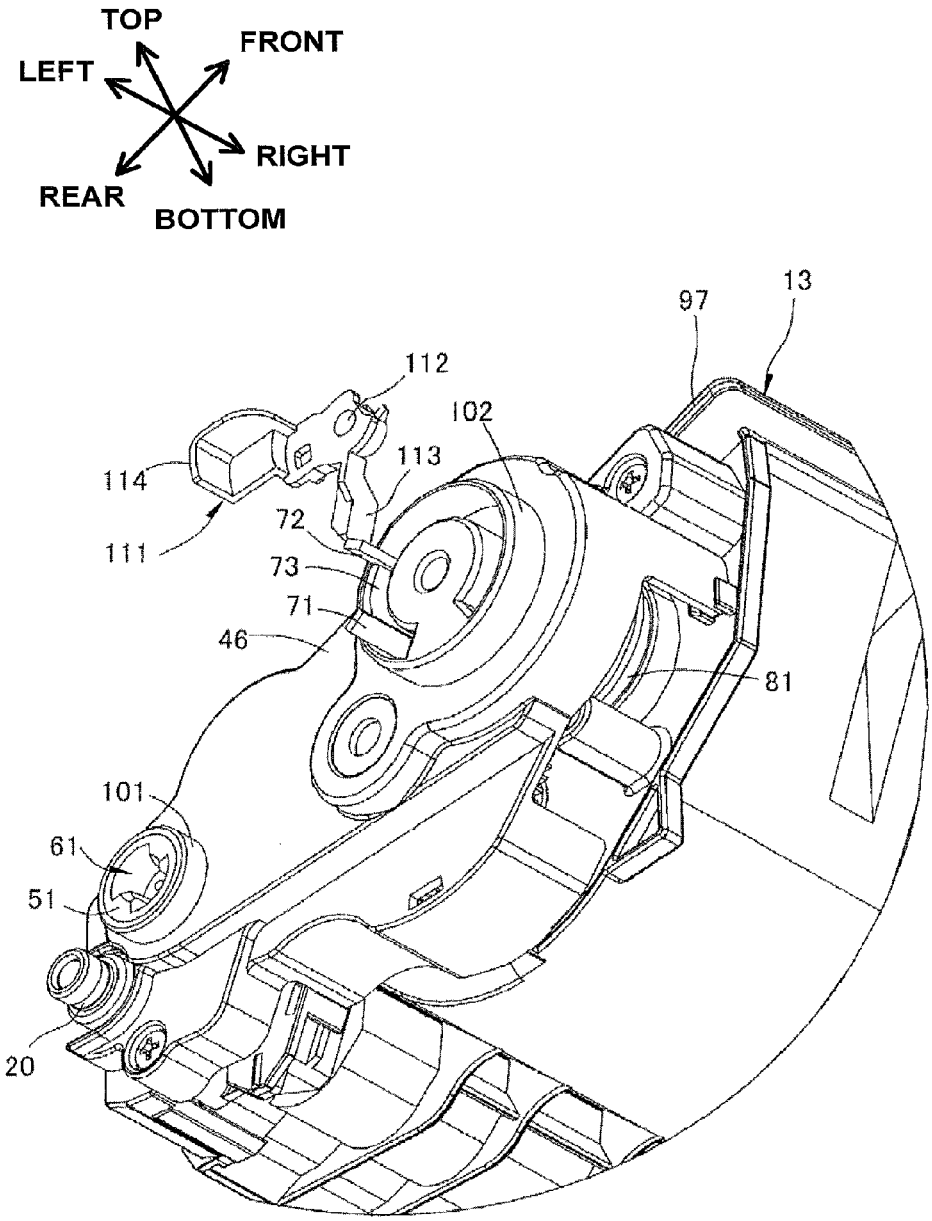
FIG. 12A is a perspective view of the example development cartridge illustrated in FIG. 2 seen from the lower front left and in a state where a second to-be-detected portion is pushing the contact lever of the actuator.
Figure 12B:
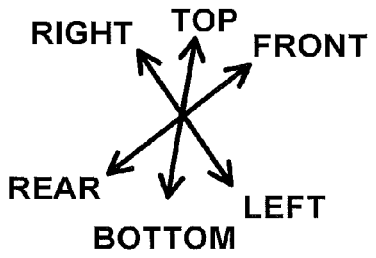
FIG. 12B is a perspective view of the example development cartridge in the state illustrated in FIG. 12A seen from the upper rear left with the gear cover removed.
Figure 12B:
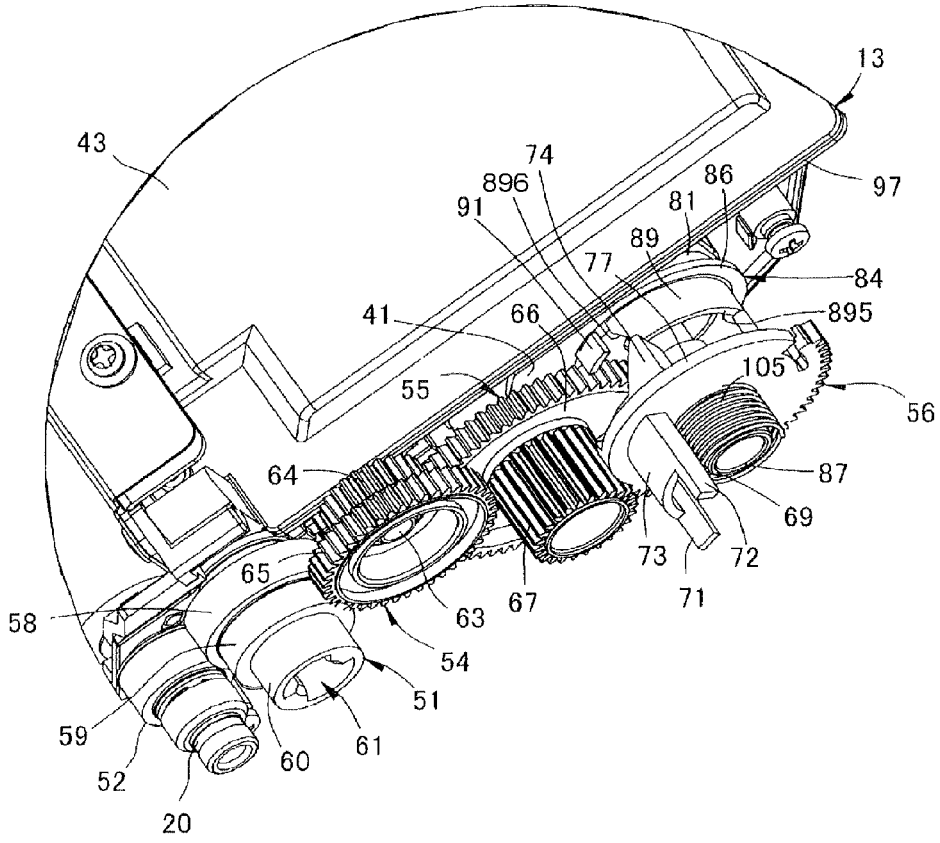
Figure 12C:
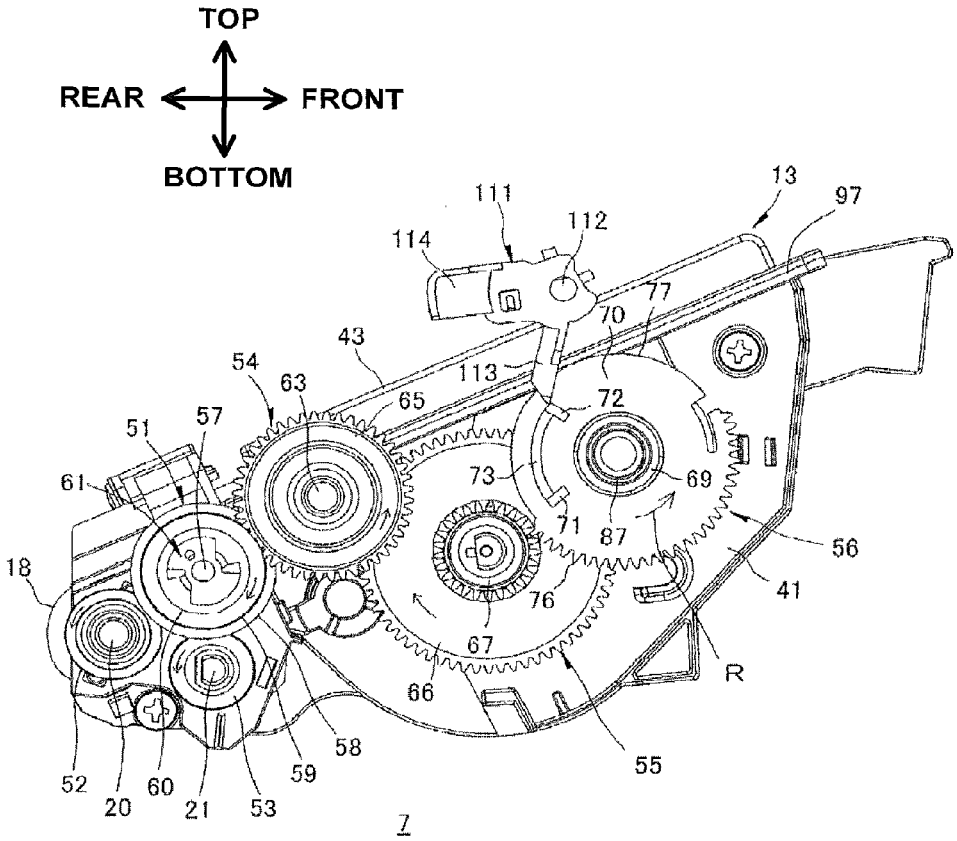
FIG. 12C is a left side view of the example development cartridge illustrated in FIG. 12A with the gear cover removed.

When the to-be-detected rotary member 56 further rotates, the second to-be-detected portion 72 comes into contact with the contact lever 113, and the second to-be-detected portion 72 pushes the contact lever 113 toward the rear as illustrated in FIGS. 12A, 12B, and 12C, whereby the actuator 111 changes the orientation thereof again from the non-detected orientation to the detected orientation. Consequently, the light-shielding lever 114 moves away from the optical path extending from the light-emitting element to the light-receiving element of the optical sensor, whereby the on-signal is output from the optical sensor again. Thus, the detection of the second to-be-detected portion 72 is achieved. In this state, the supporting portion 74 of the to-be-detected rotary member 56 is at a position near the boundary between the parallel surface 895 and the sloping surface 896 of the cam portion 89 as illustrated in FIG. 12B. Meanwhile, only some of the series of gear teeth 76 of the to-be-detected rotary member 56 on the most upstream side in the direction of rotation R are in mesh with the gear teeth of the small-diameter gear portion 67 of the agitator gear 55.

Figure 13A:
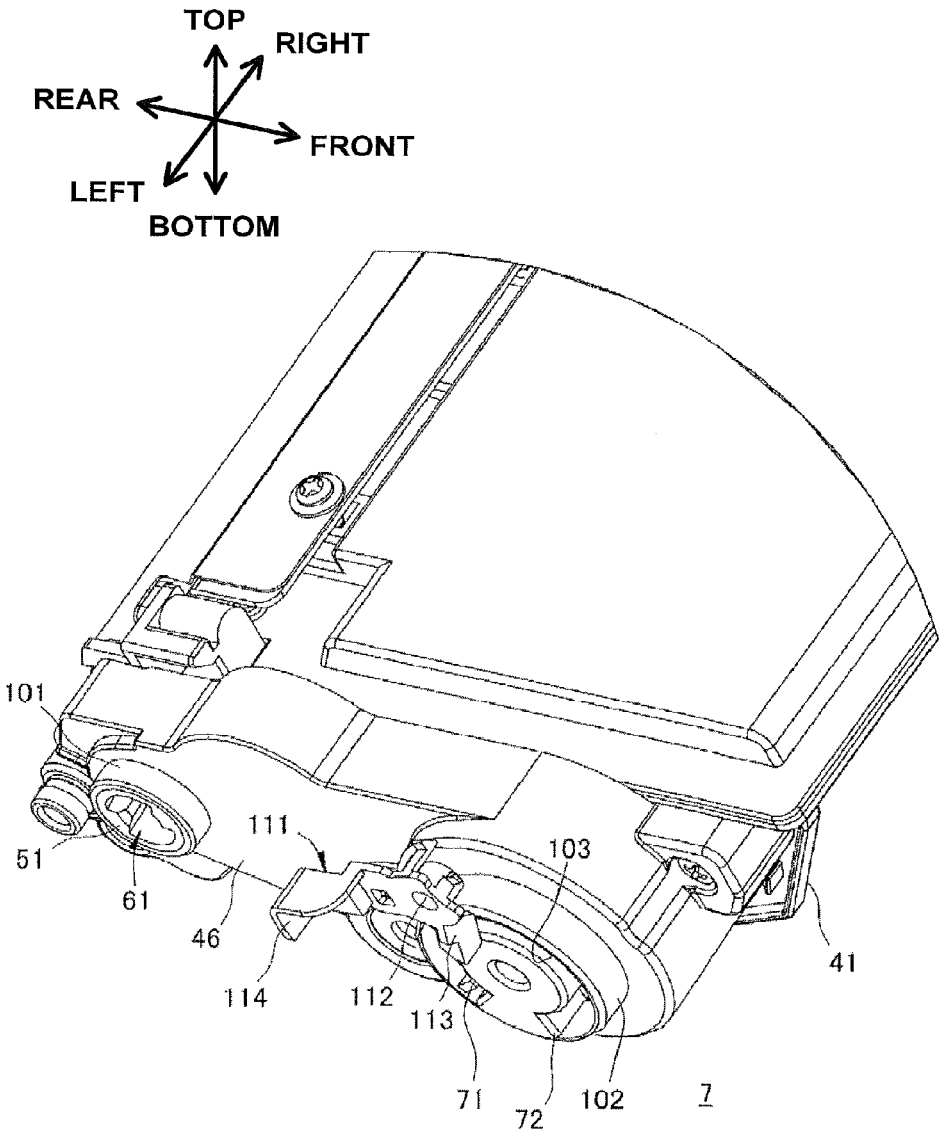
FIG. 13A is a perspective view of the example development cartridge illustrated in FIG. 2 seen from the upper front left and in a state where the second to-be-detected portion has been moved away from the contact lever of the actuator.

When the to-be-detected rotary member 56 slightly rotates from the above state, the second to-be-detected portion 72 moves away from the contact lever 113, and the actuator 111 returns from the detected orientation to the non-detected orientation. Consequently, the output signal from the optical sensor changes from the on-signal to the off-signal again. Meanwhile, as illustrated in FIG. 13C, the gear teeth 76 of the to-be-detected rotary member 56 and the gear teeth of the small-diameter gear portion 67 of the agitator gear 55 become out of mesh with each other. Furthermore, the supporting portion 74 of the to-be-detected rotary member 56 moves from the parallel surface 895 to the sloping surface 896 of the cam portion 89. The to-be-detected rotary member 56 is urged toward the left sidewall 41 by the coil spring 105 (see FIG. 12B). Therefore, when the supporting portion 74 moves to the sloping surface 896, the urging causes the supporting portion 74 to slide on the sloping surface 896 toward the second rotation-stopping portion 91. Thus, the to-be-detected rotary member 56 rotating in the direction of rotation R moves toward the right. Subsequently, when the supporting portion 74 falls off the sloping surface 896, the to-be-detected rotary member 56 jumps toward the right as illustrated in FIG. 13A with the urging force of the coil spring 105.

Figure 13B:
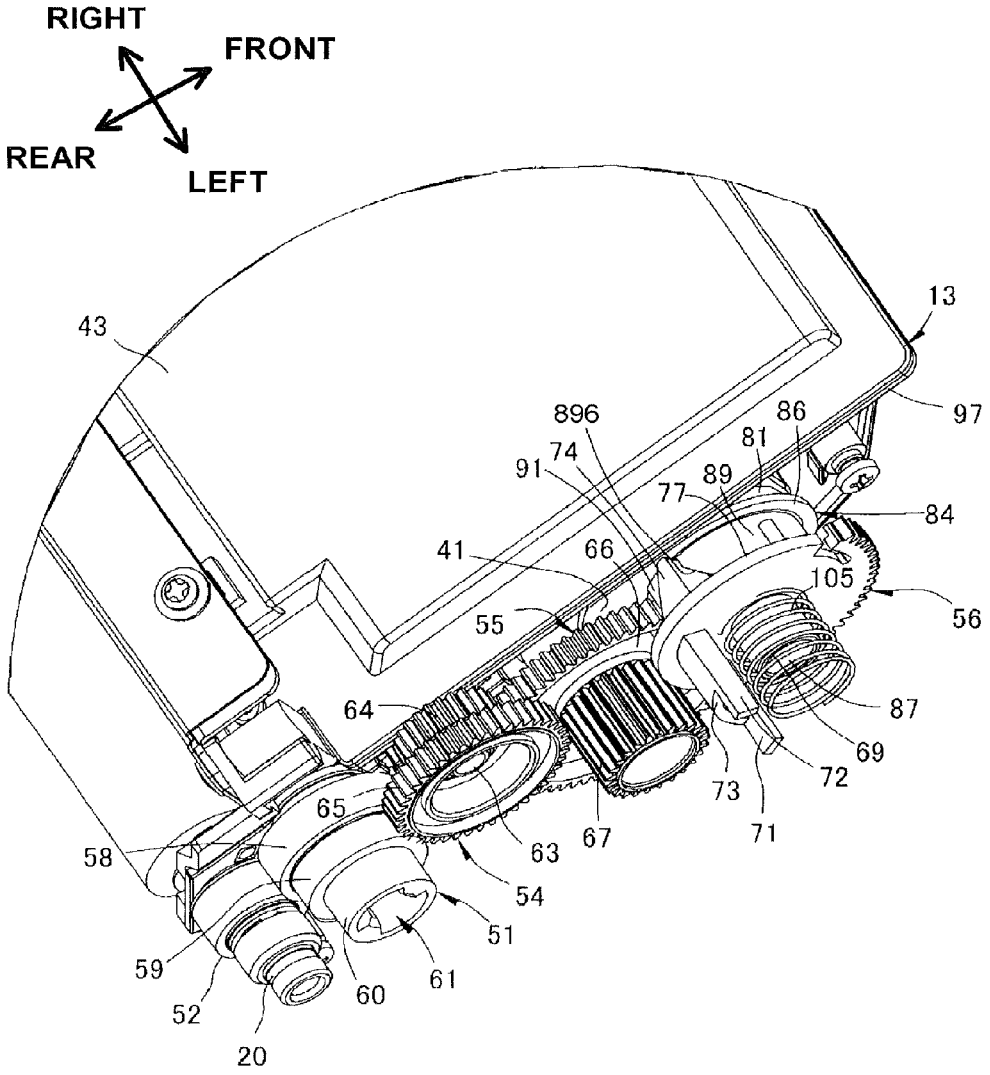
FIG. 13B is a perspective view of the example development cartridge illustrated in FIG. 13A seen from the upper left with the gear cover removed.
Figure 13C:
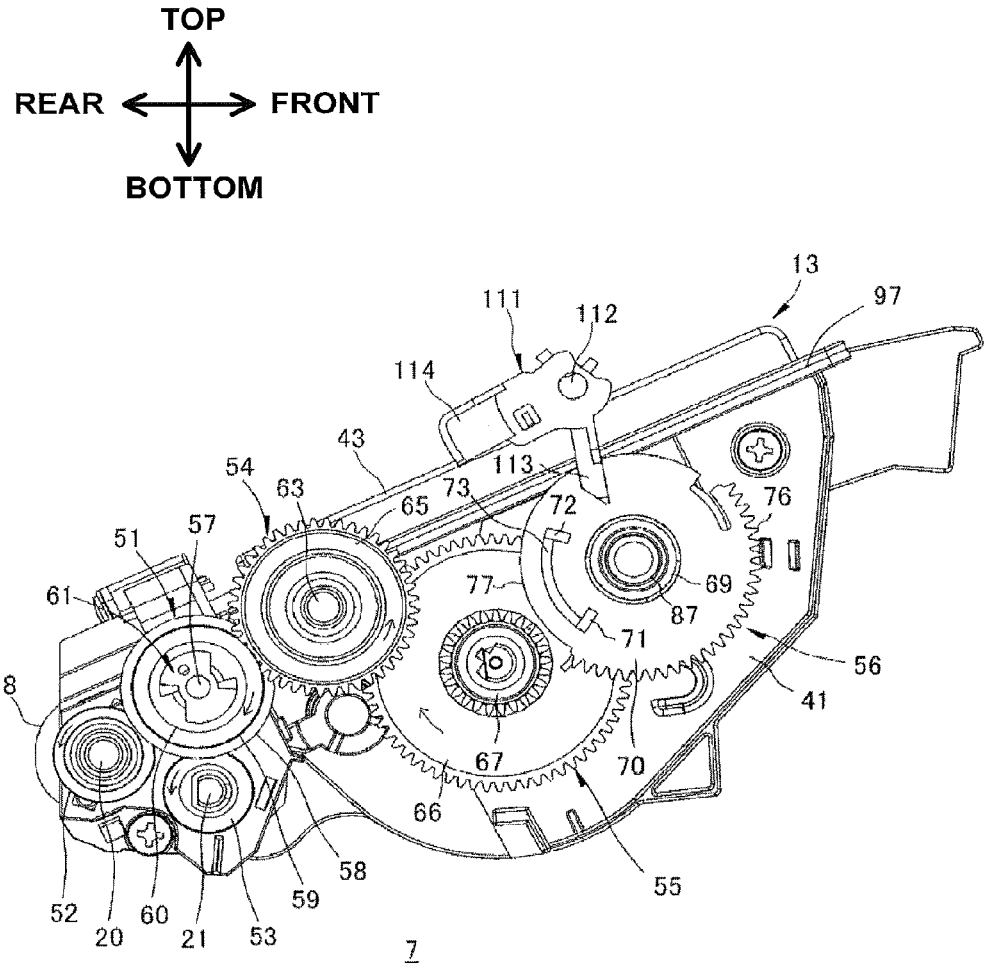
FIG. 13C is a left side view of the example development cartridge in the state illustrated in FIG. 13A with the gear cover removed.

As illustrated in FIG. 13B, the supporting portion 74 that has fallen off the sloping surface 896 is positioned between the cam portion 89 and the second rotation-stopping portion 91. Thus, the rotation of the to-be-detected rotary member 56 is stopped, and the to-be-detected rotary member 56 remains still in that position of rotation.

As described above, when a new development cartridge 7 is attached to the body casing 2 for the first time, the situation where the optical sensor outputs the on-signal occurs twice. Therefore, if the situation where the optical sensor outputs the on-signal occurs twice after any development cartridge 7 is attached to the body casing 2, it is possible to determine that the development cartridge 7 is new.

On the other hand, if a used development cartridge 7 (any development cartridge 7 that has been attached to the body casing 2 at least once) is attached to the body casing 2, the to-be-detected rotary member 56 does not rotate even if the warm-up operation of the laser printer 1 is started. Therefore, if the optical sensor does not output the on-signal within a specific period of time from when any development cartridge 7 is attached to the body casing 2, it is possible to determine that the development cartridge 7 is used.

5. Removal of Cap

When the toner in the housing 13 of the development cartridge 7 runs out, the development cartridge 7 is detached from the process cartridge 5 (drum frame 8). The development cartridge 7 that has run out of toner is to be, for example, delivered to the manufacturer of the laser printer 1. The manufacturer of the laser printer 1 removes the cap 84 from the toner supply opening 83 (see FIG. 6) of the housing 13 and supplies toner into the housing 13 from the toner supply opening 83.

Figure 14A:
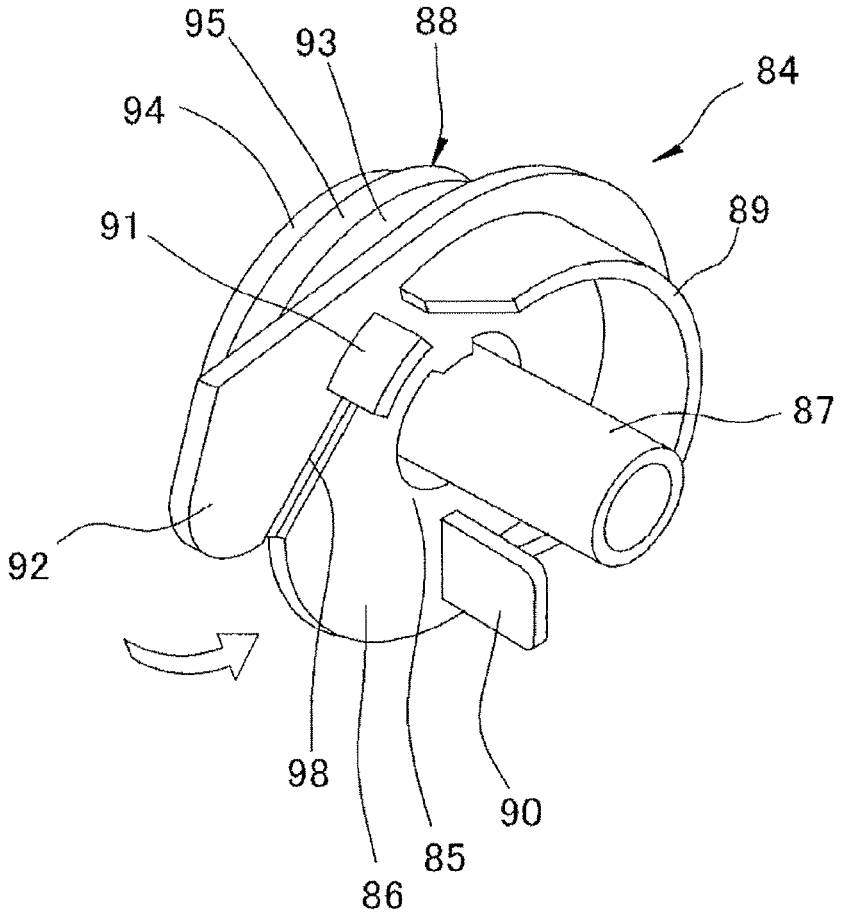
FIG. 14A is a perspective view of the example cap illustrated in FIG. 7 and in a state before the cap is removed from a toner supply opening.
Figure 14B:
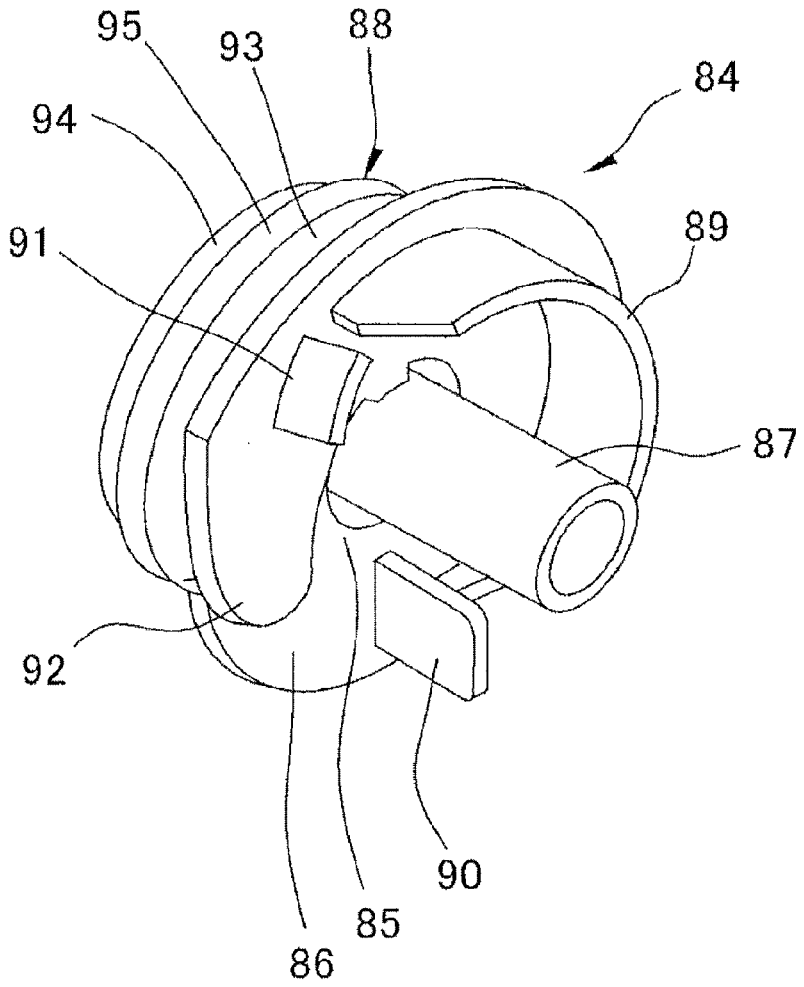
FIG. 14B is a perspective view of the example cap illustrated in FIG. 7 and in a state where the cap is being removed from the toner supply opening.

In removing the cap 84 from the toner supply opening 83, the handle portion 92 is pulled or otherwise moved, as illustrated in FIG. 14A, in a direction away from the left sidewall 41 (see FIG. 7), i.e., toward the left. The cap 84 has the thin portion 98 provided along the boundary between the sealing portion 85 and the handle portion 92. Therefore, when the handle portion 92 is pulled, the thin portion 98 is broken, and, as illustrated in FIG. 14B, the handle portion 92 is separated from the sealing portion 85.

Figure 14C:
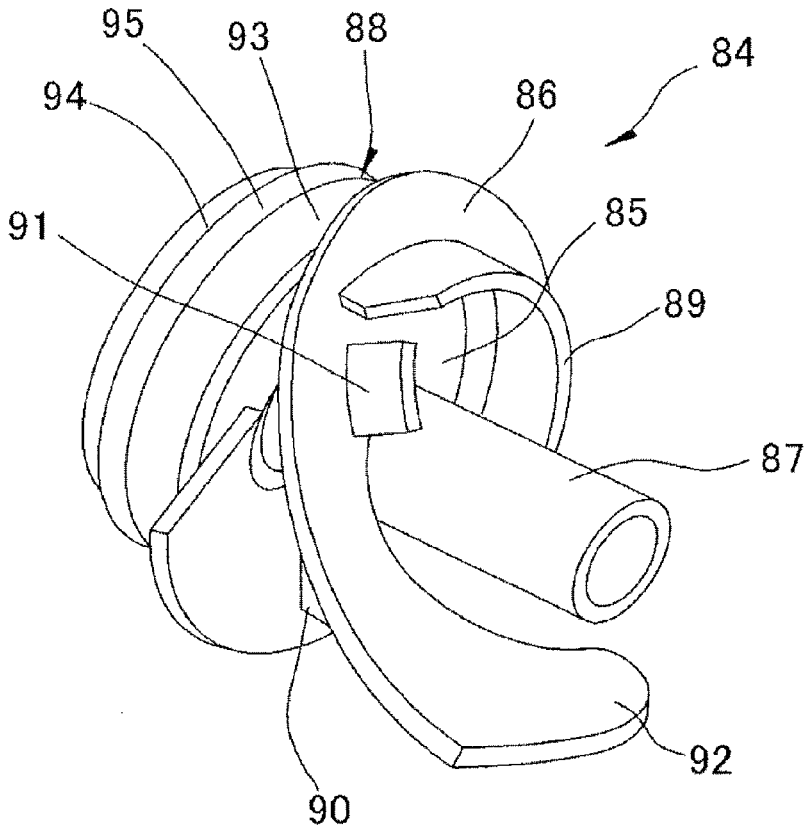
FIG. 14C is a perspective view of the example cap illustrated in FIG. 7 and in a state where the cap is being removed from the toner supply opening (a state subsequent to the state illustrated in FIG. 14B).

Subsequently, when the handle portion 92 is further pulled, a slit produced when the thin portion 98 has been broken grows longer, as illustrated in FIG. 14C, into the sealing portion 85. The portion in which a slit is to be produced in such a manner as to extend from the thin portion 98 into the sealing portion 85 is an exemplary breaking portion.

Figure 14D:
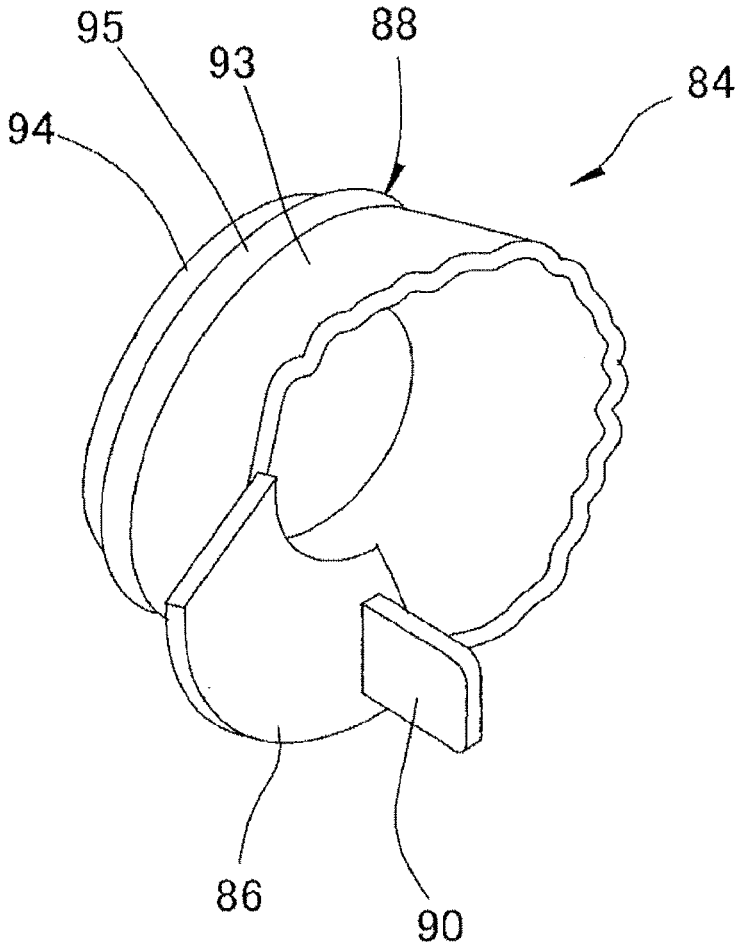
FIG. 14D is a perspective view of the example cap illustrated in FIG. 7 and in a state after the cap has been removed from the toner supply opening (a state subsequent to the state illustrated in FIG. 14C).

Subsequently, when the handle portion 92 is further pulled, the sealing portion 85 is separated from the fit-in portion 88 as illustrated in FIG. 14D, whereas the fit-in portion 88 remains in the toner supply opening 83 and a part of the contact portion 86 remains on the left sidewall 41. Therefore, the tip ends of tweezers are insertable between the toner supply opening 83 and the fit-in portion 88. By pulling and deforming the fit-in portion 88 with the tip ends of tweezers such that the diameter of the fit-in portion 88 is reduced, the cap 84 can be easily removed from the toner supply opening 83.

Figure 15:
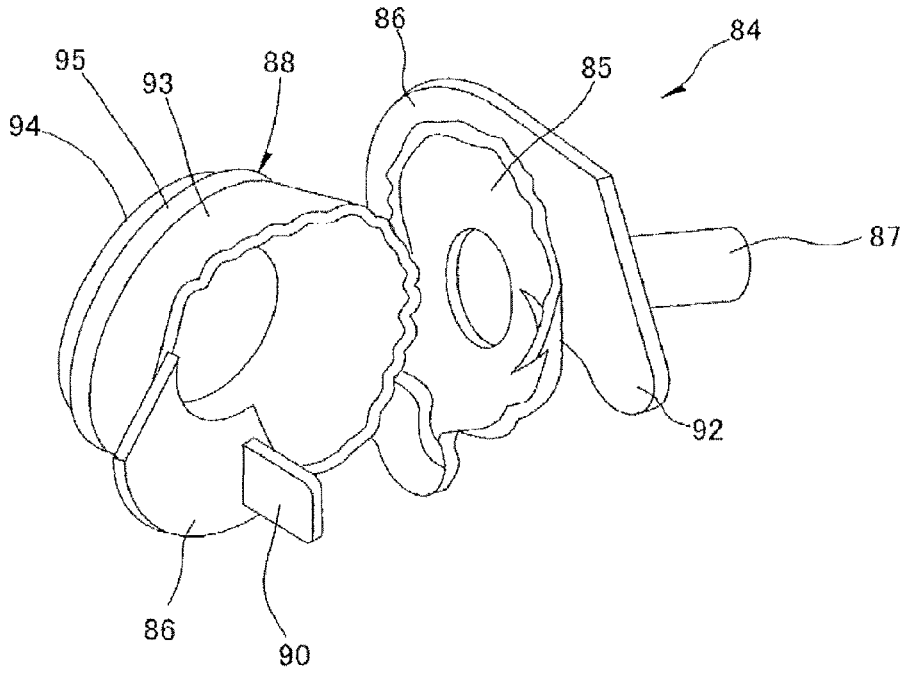
FIG. 15 is a perspective view of the example cap illustrated in FIG. 7 and in a state where the entirety of the cap is being removed from the toner supply opening (a state subsequent to the state illustrated in FIG. 14C).

Alternatively, as illustrated in FIG. 15, the cap 84 may be formed such that, when the handle portion 92 is pulled while being rotated clockwise when seen from the left in a state where the sealing portion 85 is not completely separated from the fit-in portion 88 and is connected at a part thereof to the fit-in portion 88, the slit grows from the sealing portion 85 toward the fit-in portion 88 and further grows spirally into the fit-in portion 88 so that the entirety of the cap 84 is removed from the toner supply opening 83.

Figure 16A:
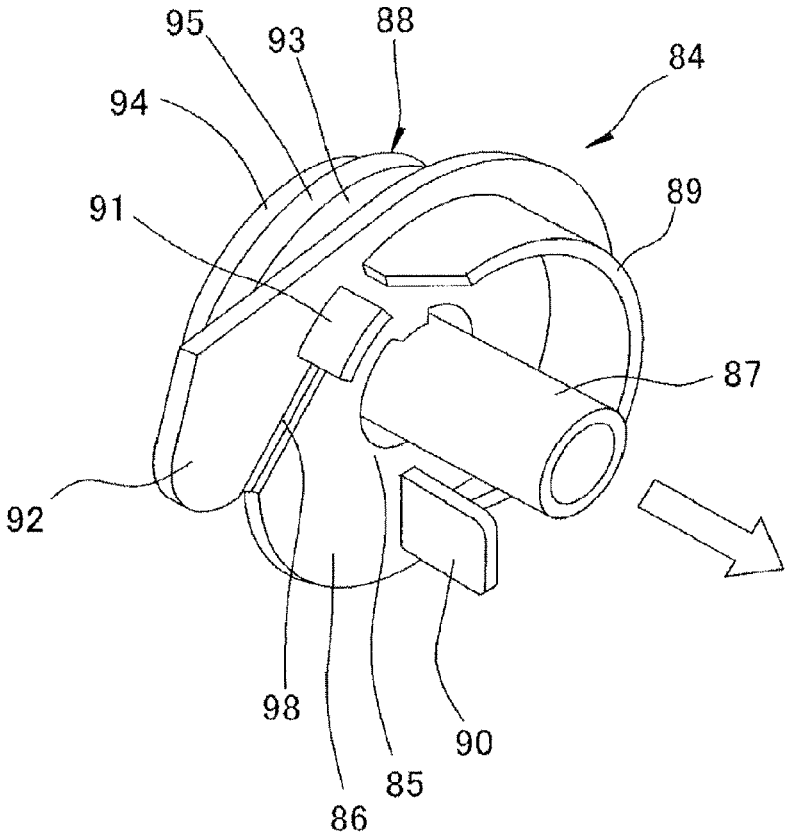
FIG. 16A is a perspective view of the example cap illustrated in FIG. 7 and in a state before the cap is removed from the toner supply opening.
Figure 16B:
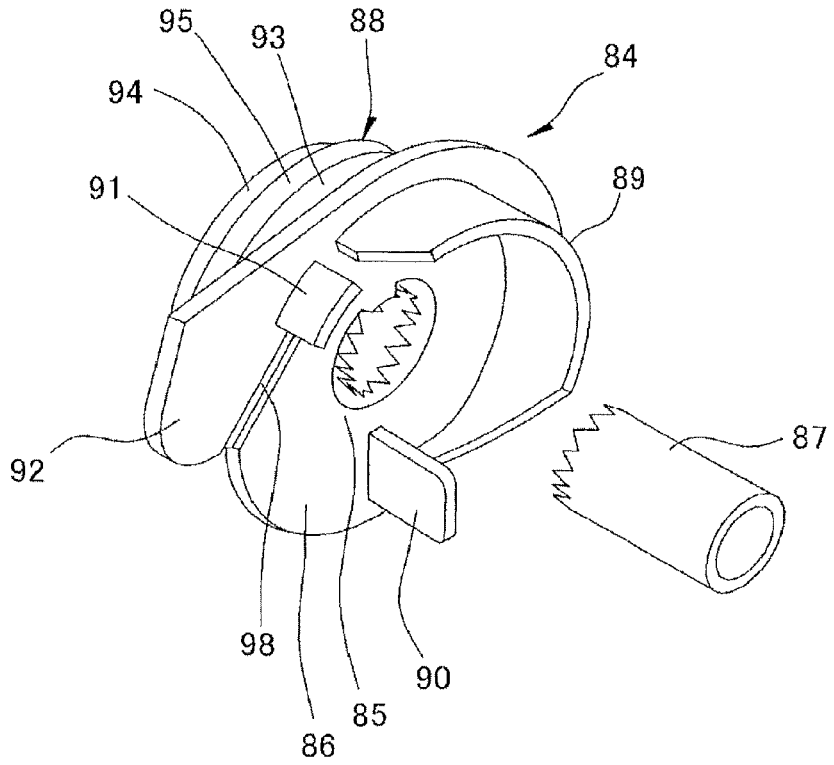
FIG. 16B is a perspective view of the example cap illustrated in FIG. 7 and in a state where a shaft portion has been torn off a sealing or covering portion.

Alternatively, the cap 84 may be formed such that, when the shaft portion 87 is pulled toward the left, the shaft portion 87 is separated from the sealing portion 85. In removing the cap 84 from the toner supply opening 83 (see FIG. 6), the shaft portion 87 is pulled toward the left as illustrated in FIG. 16A and is separated from the sealing portion 85 as illustrated in FIG. 16B, whereby the sealing portion 85 becomes easily deformable (easily deformable particularly inward in the radial direction). Therefore, by pulling the sealing portion 85 while deforming the sealing portion 85 such that the diameter thereof is reduced, the cap 84 can be easily removed from the toner supply opening 83.

6. Operational Effects (1) Operational Effect 1

As described above, the housing 13 of the development cartridge 7 includes the toner-containing chamber 14 for containing toner thereinside. The housing 13 has the toner supply opening 83. The toner supply opening 83 is tightly closed by the cap 84. The cap 84 includes the sealing portion 85 that seals the toner supply opening 83 and the shaft portion 87 for rotatably supporting the to-be-detected rotary member 56.

The to-be-detected rotary member 56 is rotatably supported by the shaft portion 87 by being fitted onto the shaft portion 87. Therefore, even if the toner supply opening 83 is provided in the sidewall of the housing 13 on which the to-be-detected rotary member 56 is provided, i.e., the left sidewall 41, the toner supply opening 83 and the to-be-detected rotary member 56 can be provided in such a manner as to overlap each other.

Accordingly, the toner supply opening 83 can be provided in the left sidewall 41 without increasing the size of the housing 13.

Furthermore, since the to-be-detected rotary member 56 is provided over the cap 84, the cap 84 can be prevented from being unnecessarily removed from the toner supply opening 83.

In a configuration in which any electrodes (for supplying power to the development roller 18 and the like) are provided on the right sidewall 42, since the toner supply opening 83 is provided in the left sidewall 41 of the housing 13, toner can be prevented from adhering to the electrodes (the electrodes are prevented from being contaminated with the toner) when the toner is supplied into the housing 13 from the toner supply opening 83. Consequently, conduction failure between terminals provided in the body casing 2 to which the development cartridge 7 is attached and the electrodes can be prevented from occurring because of the toner, and good connections between the terminals and the electrodes can be achieved.

(2) Operational Effect 2

The cap 84 further includes the fit-in portion 88 to be fitted into the toner supply opening 83. In the state where the fit-in portion 88 is in the toner supply opening 83, the toner supply opening 83 is sealed by the sealing portion 85. Furthermore, in the state where the fit-in portion 88 is in the toner supply opening 83, the shaft portion 87 extends from the sealing portion 85 toward the outer side of the housing 13. Therefore, the to-be-detected rotary member 56 can be made to fit onto the shaft portion 87 on the outer side of the fit-in portion 88.

(3) Operational Effect 3

The sealing portion 85 faces the toner supply opening 83 from the outer side of the housing 13. Furthermore, the fit-in portion 88 has a cylindrical shape extending from the sealing portion 85 and has the tip end thereof forming an open end. Therefore, the fit-in portion 88 can be easily deformed. By deforming a tip end part of the fit-in portion 88 such that the diameter thereof is reduced, the fit-in portion 88 can be easily removed from the toner supply opening 83. Accordingly, the cap 84 can be assuredly and easily removed from the toner supply opening 83.

(4) Operational Effect 4

The fit-in portion 88 includes the middle part 95 projecting toward the outer side in the radial direction thereof. In the state where the fit-in portion 88 is in the toner supply opening 83, the middle part 95 is anchored to the housing 13. Therefore, with a simple configuration, the fit-in portion 88 can be prevented from being easily removed from the toner supply opening 83.

(5) Operational Effect 5

The cap 84 has the handle portion 92 that is continuous with the sealing portion 85. The handle portion 92 is held when the fit-in portion 88 is removed from the toner supply opening 83. Furthermore, by pulling the handle portion 92 in a direction away from the housing 13, a force acting in such a direction as to move the fit-in portion 88 away from the toner supply opening 83 can be transmitted to the fit-in portion 88 through the sealing portion 85, whereby the fit-in portion 88 can be removed from the toner supply opening 83. Thus, the ease of operation of removing the cap 84 from the toner supply opening 83 can be increased.

(6) Operational Effect 6

The thin portion 98 configured to be broken when the handle portion 92 is pulled so that the fit-in portion 88 is removed from the toner supply opening 83 is provided at the boundary between the sealing portion 85 and the handle portion 92. Therefore, when the cap 84 is removed from the toner supply opening 83, the thin portion 98 is broken and the resulting slit grows into the sealing portion 85. Thus, while a force applied from the fit-in portion 88 to the housing 13 toward the outer side in the radial direction of the fit-in portion 88 is released, the entirety of the cap 84 can be removed from the toner supply opening 83. Consequently, the cap 84 can be more easily and assuredly removed from the toner supply opening 83.

(7) Operational Effect 7

The cam portion 89 for moving the to-be-detected rotary member 56 in the direction in which the shaft portion 87 extends is provided on the side of the sealing portion 85 opposite the fit-in portion 88. Therefore, while the to-be-detected rotary member 56 is rotatably supported by the shaft portion 87, the to-be-detected rotary member 56 is movable in the direction in which the shaft portion 87 extends.

(8) Operational Effect 8

Furthermore, the contact portion 86 is provided around the sealing portion 85. The contact portion 86 is in contact with the outer surface of the housing 13 in the state where the fit-in portion 88 is in the toner supply opening 83. Meanwhile, the cam portion 89 is provided on the contact portion 86. Therefore, when the to-be-detected rotary member 56 is moved in the direction in which the shaft portion 87 extends, the force applied from the to-be-detected rotary member 56 to the cam portion 89 can be received by the housing 13 through the contact portion 86. Thus, the cap 84 can be prevented from being deformed, and the to-be-detected rotary member 56 can be assuredly moved in a good manner in the direction in which the shaft portion 87 extends.

(9) Operational Effect 9

Furthermore, the cap 84 has the positioning portion 96. By bringing the positioning portion 96 into contact with the flange portion 97 of the housing 13, the position of the cap 84 relative to the housing 13 in the direction of rotation R can be determined and appropriately aligned, and the position of the cam portion 89 relative to the housing 13 in the circumferential direction of the fit-in portion 88 can be determined and appropriately aligned. Accordingly, the cap 84 can be provided over the toner supply opening 83 such that the position of the cam portion 89 relative to the housing 13 in the circumferential direction becomes constant.

(10) Operational Effect 10

The cap 84 has the second rotation-stopping portion 91. Therefore, when the supporting portion 74 of the to-be-detected rotary member 56 is positioned between the cam portion 89 and the second rotation-stopping portion 91, the rotation of the to-be-detected rotary member 56 can be stopped.

(11) Operational Effect 11

The passive gear 51 is rotatably held by the housing 13. The drive-outputting member 62 provided in the body casing 2 is connected to the passive gear 51, and a driving force is input to the passive gear 51 from the drive-outputting member 62. Furthermore, the to-be-detected rotary member 56 is rotated by the driving force from the drive-outputting member 62 received by the passive gear 51. Furthermore, the driving force received by the passive gear 51 is used for rotating the development roller 18 and so forth. Therefore, in such a configuration in which a driving force for rotating the development roller 18 and so forth is input to the passive gear 51, a driving force for rotating the to-be-detected rotary member 56 does not need to be input from another system separate from the drive-input system for the passive gear 51. Accordingly, the configuration of the development cartridge 7 can be made simpler.

(12) Operational Effect 12

Furthermore, the to-be-detected rotary member 56 is detected so that whether the development cartridge 7 is new or used is determined (e.g., indicated) with the detection mechanism including the actuator 111 and provided in the body casing 2. In other words, on the basis of the result of detection of the to-be-detected rotary member 56 performed by the detection mechanism, whether the development cartridge 7 is new or used can be indicated and determined.

(13) Operational Effect 13

The gear cover 46 that covers the to-be-detected rotary member 56 is provided on the housing 13. Furthermore, with the gear cover 46 on the housing 13, tip end of the shaft portion 87 is held by the gear cover 46. Thus, the shaft portion 87 can be prevented from undergoing flexural deformation. Consequently, the to-be-detected rotary member 56 can be rotatably supported by the shaft portion 87 in a good manner.

While an embodiment has been described above, variations may be made within the scope of the disclosure.

According to one aspect, in the configuration according to the above embodiment, the coil spring 105 is interposed between the partially-toothless gear portion 70 of the to-be-detected rotary member 56 and the inner surface of the gear cover 46, and the urging force (elastic force) of the coil spring 105 causes the to-be-detected rotary member 56 to be pressed toward the left sidewall 41. Furthermore, in the warm-up operation, when the agitator gear 55 rotates, the pushing portion 68 pushes the to-be-pushed portion 75, and the pushing causes the to-be-detected rotary member 56 to rotate in the direction of rotation R, whereby the gear teeth 76 of the to-be-detected rotary member 56 mesh with the gear teeth of the small-diameter gear portion 67 of the agitator gear 55.

Figure 17:
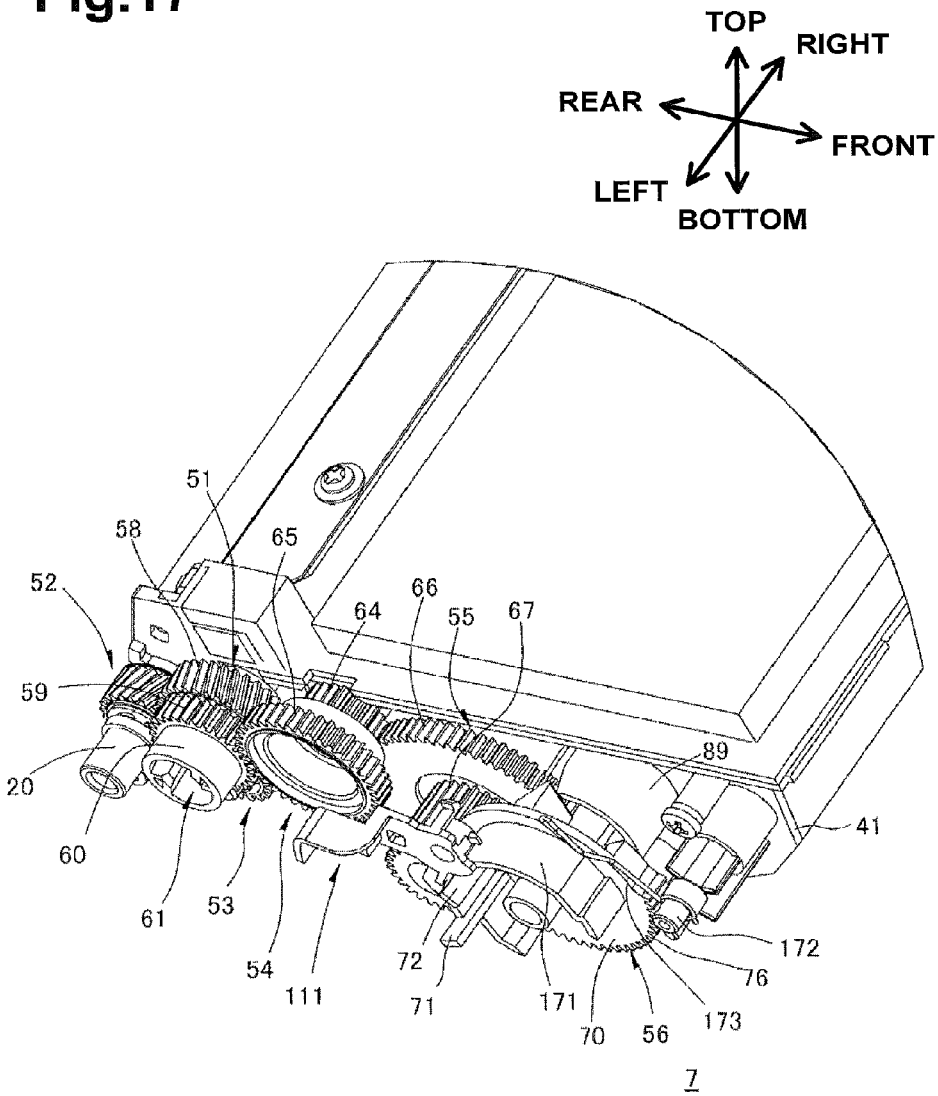
FIG. 17 is a perspective view of a left end part of an example development cartridge seen from the upper front left, the development cartridge employing a configuration in which a wire spring is provided instead of a coil spring illustrated in FIG. 5.

Instead of the above configuration, a configuration illustrated in FIG. 17 may be employed.

The configuration illustrated in FIG. 17 will now be described, describing differences from the configuration according to the above embodiment (the configuration illustrated in FIG. 5). Note that, in FIG. 17 and the subsequent drawings, elements corresponding to those described above are denoted by the same reference numerals as for the corresponding elements.

As illustrated in FIG. 17, the to-be-detected rotary member 56 further includes a to-be-pushed rib 171. The to-be-pushed rib 171 has an arc-rib shape extending from the second to-be-detected portion 72 toward the upstream side in the direction of rotation R (see FIG. 4) of the to-be-detected rotary member 56.

Note that the to-be-detected rotary member 56 illustrated in FIG. 17 does not include the to-be-pushed portion 75 (see FIG. 4). Furthermore, the agitator gear 55 illustrated in FIG. 17 does not include the pushing portion 68.

Furthermore, the left sidewall 41 has a round columnar boss 172 projecting from the outer surface thereof, the boss 172 being provided to the front of the to-be-detected rotary member 56. The boss 172 is provided with a wire spring 173 wound therearound. The wire spring 173 has one end part thereof extending toward the outer side of the partially-toothless gear portion 70 of the to-be-detected rotary member 56, a middle part thereof having a crank-like bend, and a tip end part thereof being in contact with the left end surface of the partially-toothless gear portion 70 and being also in contact with the to-be-pushed rib 171 from the front side. Meanwhile, the one end part of the wire spring 173 is anchored to the left sidewall 41. Thus, the to-be-detected rotary member 56 is urged toward the left sidewall 41 and toward the downstream side in the direction of rotation R by the urging force of the wire spring 173.

In a new development cartridge 7, the wire spring 173 urges the to-be-detected rotary member 56 toward the downstream side in the direction of rotation R. Therefore, some of the gear teeth 76 of the to-be-detected rotary member 56 in the downstream end part in the direction of rotation R are in mesh with the gear teeth of the small-diameter gear portion 67 of the agitator gear 55. Hence, when a new development cartridge 7 is attached to the body casing 2 and the agitator gear 55 is rotated after the warm-up operation of the laser printer 1 is started, a driving force is transmitted from the gear teeth of the small-diameter gear portion 67 to the gear teeth 76 of the to-be-detected rotary member 56, and the driving force causes the to-be-detected rotary member 56 to rotate in the direction of rotation R.

Thus, if the configuration illustrated in FIG. 17 is employed, the same operational effects as that produced by the configuration according to the above embodiment can be produced.

According to another aspect, in the configuration according to the above embodiment, the to-be-detected rotary member 56 includes the partially-toothless gear portion 70, and the partially-toothless gear portion 70 has the gear teeth 76 provided on the outer peripheral surface thereof.

Figure 18:
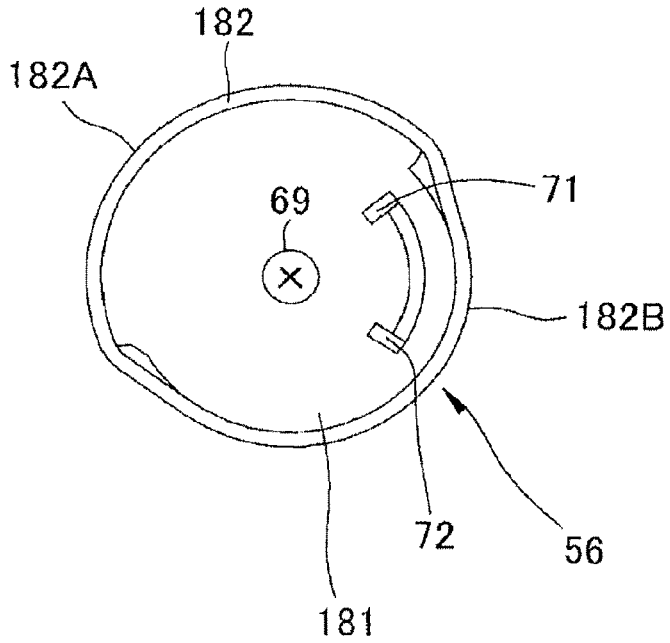
FIG. 18 is an illustrative side view of a configuration substituting for a partially-toothless gear portion of the to-be-detected rotary member.

The partially-toothless gear portion 70 may be replaced with, for example, as illustrated in FIG. 18, a sector-plate-like body 181 whose center is defined on the fitting portion 69 and a resistance-producing member 182 at least the outer peripheral surface of which is made of a material, such as rubber, having a relatively large coefficient of friction and which is provided around the outer periphery of the body 181. In such a case, the small-diameter gear portion 67 of the agitator gear 55 may have or may not have gear teeth on the peripheral surface thereof. Furthermore, the body 181 and the resistance-producing member 182 are provided in such respective sizes that a part 182B on the outer peripheral surface of the resistance-producing member 182 that is relatively on the inner side in the radial direction does not come into contact with the small-diameter gear portion 67, whereas an arc surface 182A on the outer peripheral surface that is relatively on the outer side in the radial direction comes into contact with the peripheral surface of the small-diameter gear portion 67.

According to yet another aspect, in the configuration according to the above embodiment, the first to-be-detected portion 71, the second to-be-detected portion 72, and the connecting portion 73 of the to-be-detected rotary member 56 stand from the left end surface of the partially-toothless gear portion 70.

Figure 19:
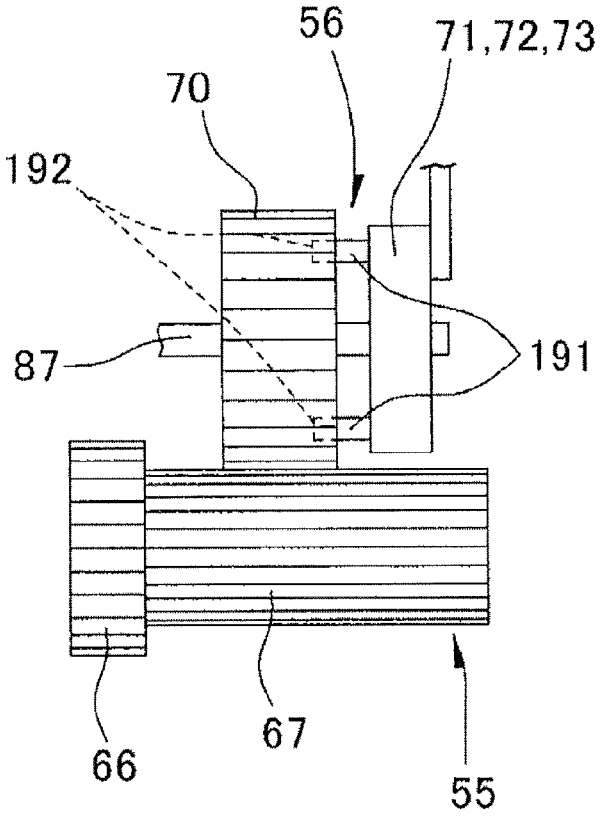
FIG. 19 is a plan view of a configuration in which the first to-be-detected portion, the second to-be-detected portion, and a connecting portion are provided separately from the partially-toothless gear portion.

Instead of such a configuration, as illustrated in FIG. 19, the first to-be-detected portion 71, the second to-be-detected portion 72, and the connecting portion 73 may be provided as an integral body separate from the partially-toothless gear portion 70, and may be connected to the partially-toothless gear portion 70 in such a manner as to be rotatable together (not to be rotatable relative thereto). In such a case, the partially-toothless gear portion 70 and so forth are rotatably fitted onto the shaft portion 87.

In this case, for example, two bosses 191 are provided on a member forming an integral body including the first to-be-detected portion 71, the second to-be-detected portion 72, and the connecting portion 73, and two recesses 192 corresponding to the bosses 191 are provided in the partially-toothless gear portion 70. Furthermore, by fitting the bosses 191 into the respective recesses 192, the first to-be-detected portion 71, the second to-be-detected portion 72, and the connecting portion 73 and the partially-toothless gear portion 70 are connected to each other in such a manner as to be rotatable together.

According to still another aspect, in the configuration according to the above embodiment, as illustrated in FIG. 6, the inner peripheral surface defining the toner supply opening 83 (the cap-attaching portion 81) has a step, whereby the middle part 95 of the fit-in portion 88 functions as an anchor catch that is anchored at the step of the inner peripheral surface defining the toner supply opening 83 in the state where the fit-in portion 88 of the cap 84 is in the toner supply opening 83.

Figure 20:
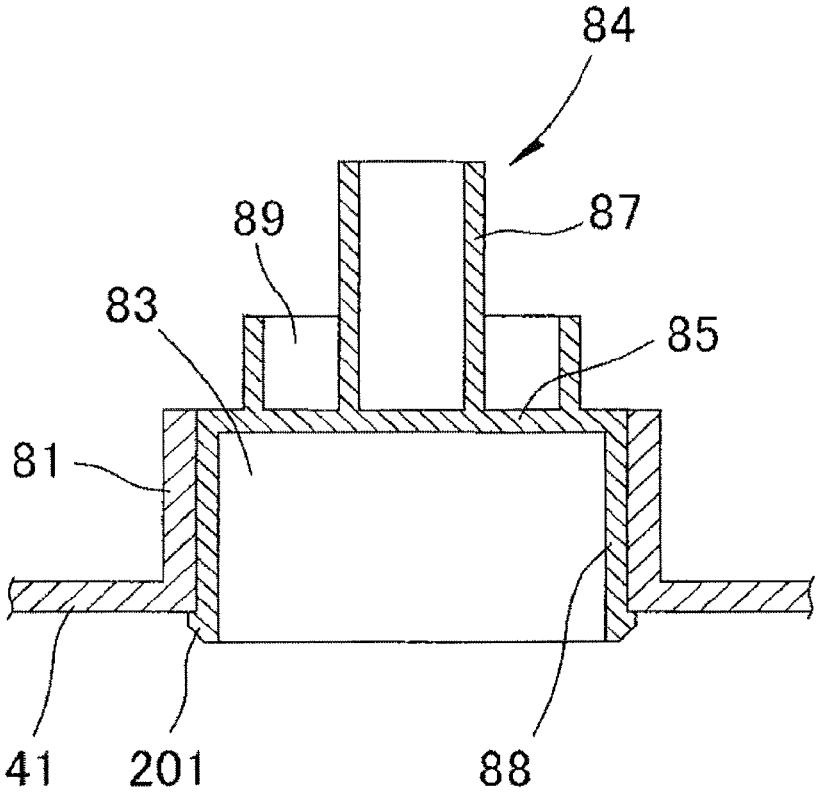
FIG. 20 is a sectional view of an example toner supply opening (e.g., a cap-attaching portion) and an example cap according to an arrangement.

Instead of such a configuration, a configuration illustrated in FIG. 20 may be employed. In the configuration illustrated in FIG. 20, the inner peripheral surface defining the toner supply opening 83 have no steps. Furthermore, in the cap 84, the contact portion 86 is omitted, and the fit-in portion 88 has at the tip end part thereof a catch portion 201 having a substantially triangular tapering shape in sectional view and projecting toward the outer side in the radial direction of the fit-in portion 88. Furthermore, by fitting the fit-in portion 88 into the toner supply opening 83 and anchoring the catch portion 201 to the inner surface of the left sidewall 41, the cap 84 is attached to the toner supply opening 83.

Figure 21:
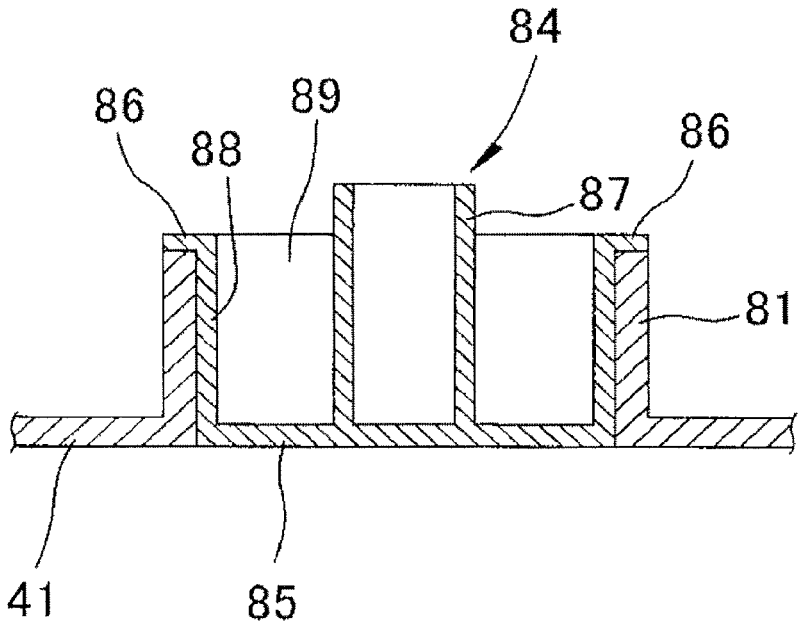
FIG. 21 is a sectional view of an example toner supply opening (e.g., a cap-attaching portion) and an example cap according to another arrangement.
Figure 22:
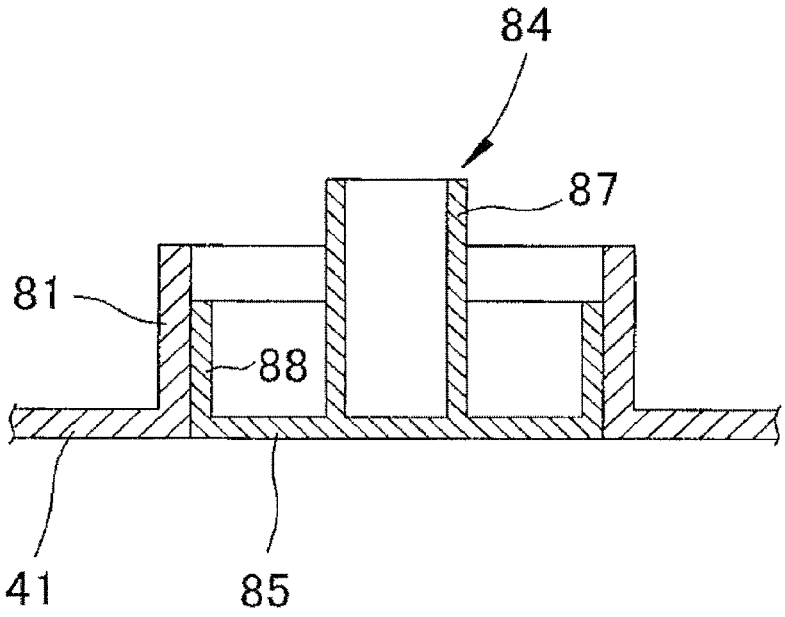
FIG. 22 is a sectional view of an example toner supply opening (e.g., a cap-attaching portion) and an example cap according to yet another arrangement.

According to yet another aspect, instead of the configuration illustrated in FIG. 20, a configuration illustrated in FIG. 21 may be employed. In the configuration illustrated in FIG. 21, the sealing portion 85 is provided such that the shaft portion 87 and the right end part of the fit-in portion 88 are connected to each other. In addition, the contact portion 86 that comes into contact with the cap-attaching portion 81 from the outer side (left side) projects from the left end part of the fit-in portion 88 toward the outer side in the radial direction of the fit-in portion 88.

Furthermore, according to yet another aspect as illustrated in FIG. 21, the contact portion 86 and the cam portion 89 may be omitted from the cap 84 configured as illustrated in FIG. 20. Instead, the cap-attaching portion 81 may have the same shape as the cam portion 89 so that the function of the cam portion 89 is added to the cap-attaching portion 81.

Still further, according to another aspect, the present invention is not limited to application to the development cartridge 7 and may also be applied to any configuration not including the development roller 18, e.g., any cartridge other than the development cartridge, such as a toner cartridge that contains in a housing thereof toner alone or toner and an agitator.

The invention claimed is:

1. A cap configured to be attached to a toner supply opening provided in a housing having thereinside a space for storing toner, the cap comprising:

a covering portion comprising a surface, the covering portion configured to cover the toner supply opening;

a shaft portion around which a rotary member is to be fitted, the shaft portion configured to rotatably support the rotary member; and a projection portion projecting from the surface, the projection portion partially surrounding the shaft portion, wherein the projection portion comprises:

a first projection part, wherein a length of the first projection part from the surface increases gradually.

2. The cap according to claim 1, further comprising a fit-in portion configured to fit into the toner supply opening, wherein the covering portion is configured to cover the toner supply opening when the fit-in portion is in the toner supply opening, and wherein the shaft portion extends from the covering portion and away from the housing when the fit-in portion is in the toner supply opening.

3. The cap according to claim 2, further comprising a rotation-restricting portion provided on the covering portion and configured to restrict rotation of the rotary member.

4. The cap according to claim 1, wherein the covering portion is configured to cover the toner supply opening from an outer side of the housing, and wherein the cap further includes a fit-in portion configured to fit into the toner supply opening, the fit-in portion having a cylindrical shape, the fit-in portion including:

a base end connected to the covering portion; and a tip end, the tip end being an open end.

5. The cap according to claim 4, wherein the fit-in portion includes an engaging portion projecting toward an outside of the housing in a radial direction of the fit-in portion, wherein the engaging portion is configured to engage the housing when the fit-in portion is in the toner supply opening.

6. The cap according to claim 4, further comprising a handle portion continuous with the covering portion and extending perpendicularly to a longitudinal axis of the shaft portion.

7. The cap according to claim 6, further comprising a breaking portion configured to be broken when the handle portion is moved away from the covering portion and the fit-in portion is removed from the toner supply opening.

8. The cap according to claim 1, further comprising a cam portion including the projection portion, the cam portion configured to move the rotary member along the first projection part in a direction in which the shaft portion extends.

9. The cap according to claim 8, further comprising a contact portion provided around the covering portion and configured to contact an outer surface of the housing when a fit-in portion is in the toner supply opening, wherein the cam portion extends from the contact portion.

10. The cap according to claim 8, further comprising a positioning portion configured to align the cam portion relative to the housing in a circumferential direction of a fit-in portion.

11. The cap according to claim 1, further comprising a contact portion configured to contact the housing when a fit-in portion is in the toner supply opening, wherein the shaft portion extends from the covering portion and beyond the contact portion.

12. The cap according to claim 1, wherein the projection portion further comprises:

a second projection part continuing from the first projection part; and a third projection part continuing from the second projection part, wherein a length of the third projection part from the surface decreases gradually.

13. A cartridge comprising:

a housing having a space therein for storing toner, the housing having a toner supply opening for supplying toner into the space;

a cap configured to close the toner supply opening, the cap comprising:

a shaft portion;

a covering portion configured to cover the toner supply opening; and a projection portion projecting from the surface, the projection portion partially surrounding the shaft portion;

wherein the projection portion comprises:

a first projection part, wherein a length of the first projection part from the surface increases gradually;

a rotary member configured to be fitted around the shaft portion and to be rotatably supported by the shaft portion.

14. The cartridge according to claim 13, wherein the cap includes a rotation restricting portion configured to restrict rotation of the rotary member.

15. The cartridge according to claim 13, further comprising a driven member rotatably provided on the housing and configured to receive a driving force from a drive-outputting member, wherein the rotary member is configured to be rotated by the driving force received by the driven member.

16. The cartridge according to claim 13, wherein the rotary member is configured to indicate whether the cartridge is new or used.

17. The cartridge according to claim 13, further comprising a cover provided on the housing and configured to cover the rotary member, wherein a tip end of the shaft portion is configured to be held by the cover.

18. The cartridge according to claim 13, wherein the projection portion further comprises:

a second projection part continuing from the first projection part; and a third projection part continuing from the second projection part, wherein a length of the third projection part from the surface decreases gradually.

19. A cap for a toner cartridge, the cap comprising:

a covering portion comprising a surface;

a shaft portion extending from the surface; and a projection portion projecting from the surface, the projection portion partially surrounding the shaft portion;

wherein the projection portion comprises:

a first projection part, wherein a length of the projection part from the surface increases gradually.

20. The cap according to claim 19, wherein the projection portion further comprises:

a second projection part continuing from the first projection part; and a third projection part continuing from the second projection part, wherein a length of the third projection part from the surface decreases gradually.

* * * * *